US005431203A

United States Patent [19]

Schultz et al.

[11] Patent Number: 5,431,203

[45] Date of Patent: Jul. 11, 1995

[54] COMPRESSED GAS TANK FILLING SYSTEM WITH IMPROVED VALVE

[75] Inventors: Richard M. Schultz, Marengo; Arthur M. Koch, Barrington; Joseph A. Lafrenz, Schaumburg; Andrew K. Miraldi, Marengo, all of Ill.

[73] Assignee: R. M. Schultz & Associates, Inc., McHenry, Ill.

[21] Appl. No.: 106,304

[22] Filed: Aug. 12, 1993

[51] Int. Cl.[6] ..... B65B 1/04; B65B 3/04

[52] U.S. Cl. ..... 141/197; 141/39; 141/83; 141/95; 251/129.11

[58] Field of Search ..... 251/81, 58, 129.11; 141/47, 51, 54, 197, 39, 4, 83, 95, 99

[56] References Cited

U.S. PATENT DOCUMENTS

| | | | |
|---|---|---|---|
| 2,075,408 | 3/1937 | Sholes | 226/20 |
| 2,645,907 | 7/1953 | Droste et al. | 62/1 |
| 3,208,574 | 9/1965 | Anson | 194/3 |
| 3,799,218 | 3/1974 | Douglass | 141/18 |
| 3,817,299 | 6/1974 | Koehler | 141/82 |
| 4,114,465 | 9/1978 | Troy | 251/129.11 |
| 4,153,083 | 5/1979 | Imler et al. | 141/4 |
| 4,500,478 | 2/1985 | Furkawa | 251/129.11 |
| 4,527,600 | 7/1985 | Fisher et al. | 141/4 |
| 4,648,430 | 3/1987 | DiGianfilippo et al. | 141/1 |
| 4,856,565 | 8/1989 | Schoeffl et al. | 141/97 |
| 4,873,957 | 10/1989 | Ueyama et al. | 251/129.11 |
| 4,904,904 | 2/1990 | Zarate | 315/219 |
| 4,934,418 | 6/1990 | Buiguez et al. | 141/4 |
| 4,966,206 | 10/1990 | Baumann et al. | 141/83 |
| 4,993,462 | 2/1991 | Oxley et al. | 141/346 |
| 5,029,622 | 7/1991 | Mutter | 141/4 |
| 5,121,774 | 6/1992 | Hicks et al. | 141/38 |
| 5,139,057 | 8/1992 | Benedetti | 141/18 |
| 5,238,030 | 8/1993 | Miller et al. | 141/4 |

OTHER PUBLICATIONS

R. M. Schultz and Associates, Inc. Air Fill Systems Price List Jan. 1992 (2 pages).

*Primary Examiner*—Ernest G. Cusick
*Assistant Examiner*—Steven O. Douglas
*Attorney, Agent, or Firm*—Willian Brinks Hofer Gilson & Lione

[57] ABSTRACT

An automatic filling system for a compressed gas tank includes a controller that measures the rate of fill of a tank being filled in order to provide an accurate estimate of the fill time for the tank, given available source pressure. Compressed gas flow is controlled with on/-off valves that are driven open by a motor/gearbox-/clutch combination to reduce thermal and physical shocks associated with opening of the valve. Whenever power is removed from the clutch, a spring automatically drives the valves closed quickly to provide fail-safe operation.

6 Claims, 36 Drawing Sheets

COMPRESSED GAS TANK FILLING SYSTEM WITH IMPROVED VALVE

BACKGROUND OF THE INVENTION

The present invention relates to improvements to a compressed gas tank filling system of the type comprising a source conduit configured for connection to a source of compressed gas, a fill conduit configured for connection to a tank to be filled, a flow control conduit interconnecting the source conduit on the fill conduit, a flow control valve coupled to the flow control conduit to control the flow of compressed gas through the fill conduit, a pressure transducer in one of the conduits, downstream of the flow control valve, and a controller coupled to the flow control valve and responsive to the pressure transducer.

The Assignee of the present invention has marketed a compressed gas tank filling system of the type described above under the trade name TFS 5000. This system allows air tanks such as SCUBA tanks and breathing apparatus tanks for firefighters to be filled automatically with compressed air from a compressor or from a bank of tanks operating as a reservoir.

Though this prior art system operated effectively and reliably, it did not include the features described and claimed below. These features represent substantial improvements to the efficiency and operation of a compressed gas tank filling system.

SUMMARY OF THE INVENTION

According to this invention, the flow control valve of the compressed gas tank filling system described above includes an on/off valve, a motor coupled to the on/off valve to drive the on/off valve to an open position, and a clutch interposed between the motor and the on/off valve. The clutch interconnects the motor and the on/-off valve when an operating voltage is supplied, and the clutch disconnects the motor and the on/off valve when the operating voltage is absent. A spring biases the on/off valve to a closed position with sufficient force to close the on/off valve when the clutch disconnects the motor and the on/off valve. This arrangement provides automatic closing the on/off valve when power is removed from the clutch. In addition, the motor can be chosen to provide gradual opening of the on/off valve, thereby reducing physical and thermal shock to the pneumatic system.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
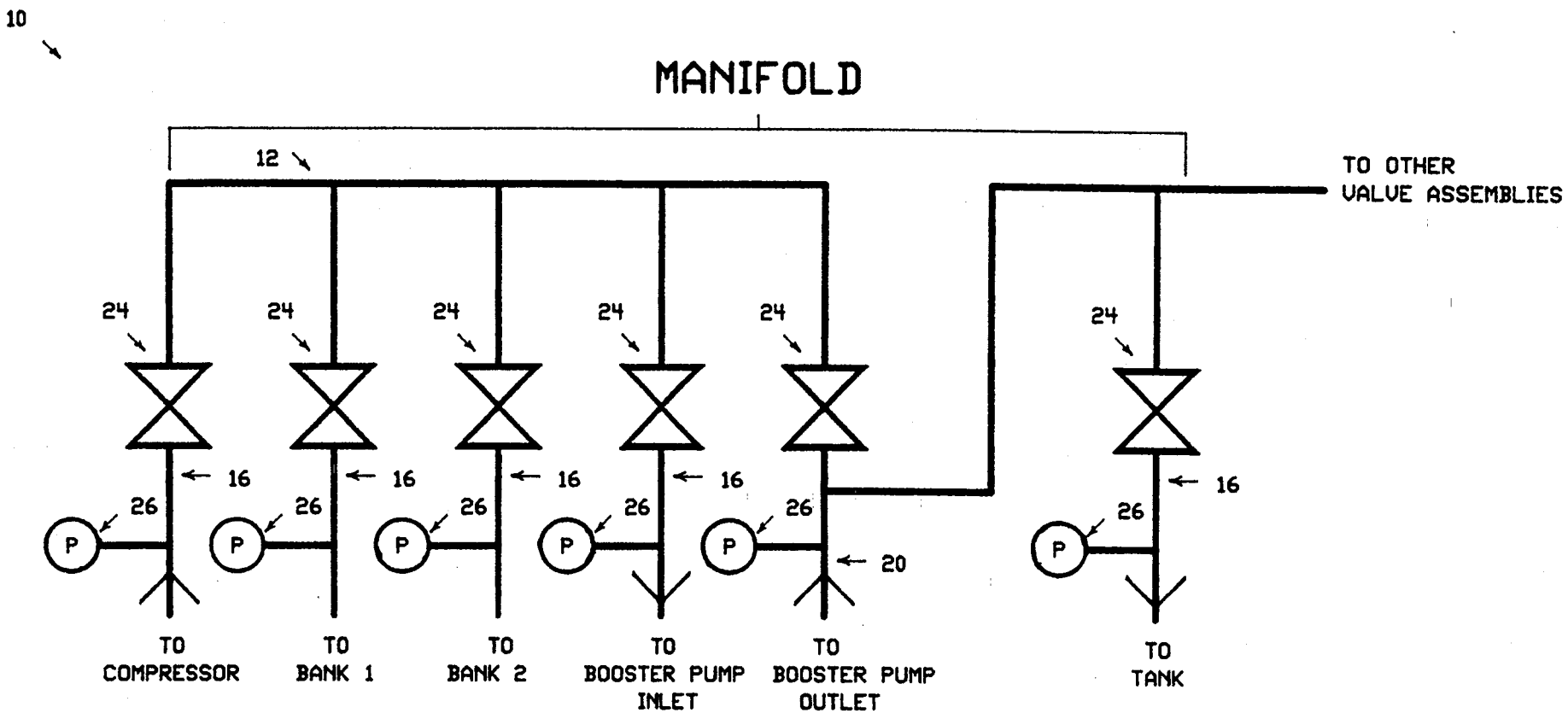
FIG. 1 is a pneumatic block diagram of a tank filling system which incorporates a presently preferred embodiment of this invention.

Turning now to the drawings, FIG. 1 shows a pneumatic block diagram of a tank filling system 10 which incorporates a presently preferred embodiment of this invention. By way of example, the tank filling system 10 can be used to fill tanks of compressed air automatically, Such as tanks used in breathing apparatus for firefighters and SCUBA divers. Of course, this invention is not limited to compressed air tank filling systems. Instead, it can be modified readily for use with a wide variety of compressed gasses, such as compressed natural gas for example.

As shown in FIG. 1, the system 10 is adapted for connection to a compressor, one or more banks, a booster pump, and one or more tanks to be filled. In this example, the compressor is an air compressor capable of providing compressed air at a pressure up to 6,000 psi. The system 10 controls the compressor to minimize on/off cycling and related wear of the compressor.

The system 10 is adapted for connection to one or more banks, each of which stores compressed air for use in filling tanks. A bank will typically include one or more compressed air storage cylinders, and multiple banks may be maintained at different pressures or at the same pressure. In many cases, one of the banks will be maintained as the highest pressure (and therefore the highest cost) storage tanks, while the balance are maintained at lower pressures. The system 10 automatically manages the pressures of the banks based upon preset limits for each of the banks. The system utilizes the banks as a higher priority source of compressed air than the compressor in order to minimize compressor cycling. Sequencing and filling of the banks is fully automatic.

A booster pump is a device having one or more pressurized gas inlets and a pressurized gas outlet. The booster pump utilizes a portion of the lower pressure inlet gas to pressurize the remaining portion of the inlet gas at the outlet. The system 10 operates as described below to provide compressed air to the booster pump inlet at appropriate times, and to route compressed air from the booster pump outlet to the tank being filled.

By way of example, the tank being filled can be a air cylinder with a J valve or a K valve. Such cylinders typically have a severe flow restriction at the tank valve. As described below, the system 10 fills such tanks efficiently, without directly measuring the internal pressure of the tank while compressed air is being added to the tanks.

As shown in FIG. 1, the system 10 includes a manifold 12 which is connected to the compressor via a compressor conduit 14, to the banks by bank conduits 16, to the booster pump by booster pump inlet and outlet conduits 18, 20, and to the tank being filled by a fill conduit 22. Both the compressor and the banks can be considered sources of compressed air, and therefore the compressor conduit 14 and the bank conduit 16 will be referred to collectively as source conduits herein.

Each of the conduits 14 through 22 can be selectively isolated from the manifold 12 via a respective flow control valve 24, and the instantaneously prevailing pressure in any one of the conduits 14 through 22 can be measured by means of a solid state pressure transducer 26.

Figure 2:
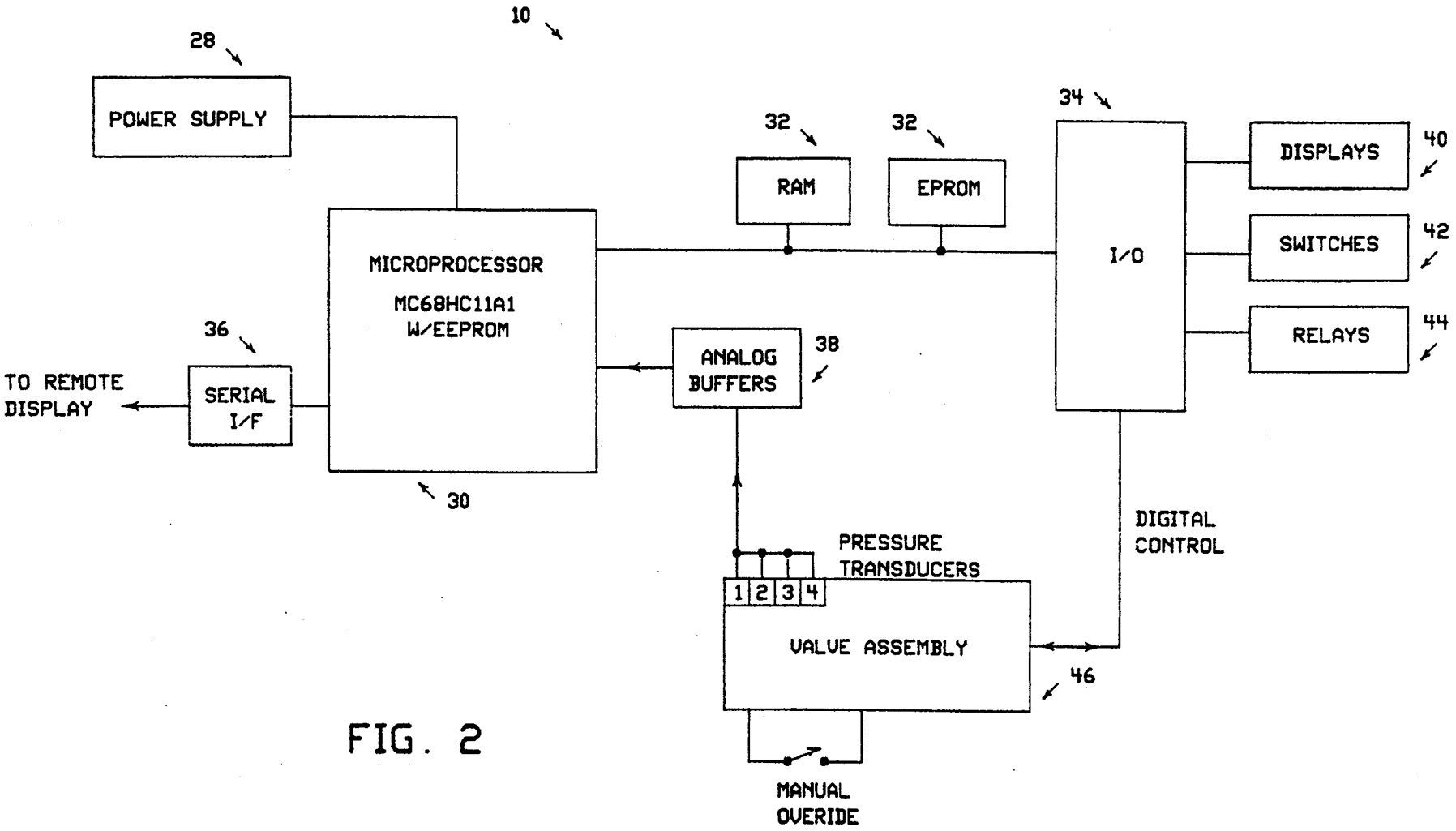
FIG. 2 is an electrical block diagram of the tank filling system of FIG. 1.

FIG. 2 shows an electrical block diagram of a control system included in the tank filling system 10. This control system responds to user inputs and pressures as measured by the transducers 26 to control the valves 24 to automatically fill tanks connected to the fill conduit 22 with compressed air from either the banks or the compressor as appropriate.

As shown in FIG. 2 the control system 28 includes a microprocessor 30 which is connected to memory 32, an I/O interface 34, serial interface 36 and analog buffers 38. The microprocessor 30 controls displays 40, receives digital inputs from switches 42, and controls replays 44 via the I/O interface 34. The displays 40 and switches 42 are described below in conjunction with FIGS. 3 through 6. The relays 44 include a compressor on relay which when open turns the compressor on, and a compressor inhibit relay, which when closed prevents compressor operation.

The I/O interface 34 is also connected to one or more valve assemblies 46. Each valve assembly 46 includes four of the valves 24, along with the four associated pressure transducers 26. The analog signals generated by the pressure transducers 26 are supplied via the analog buffers 38 to the microprocessor 30 for measurement.

FIGS. 3 through 6 are front views of respective control panels included in the system 10, and these figures will be used to provide a general overview of the operation of the system 10.

Figure 3:
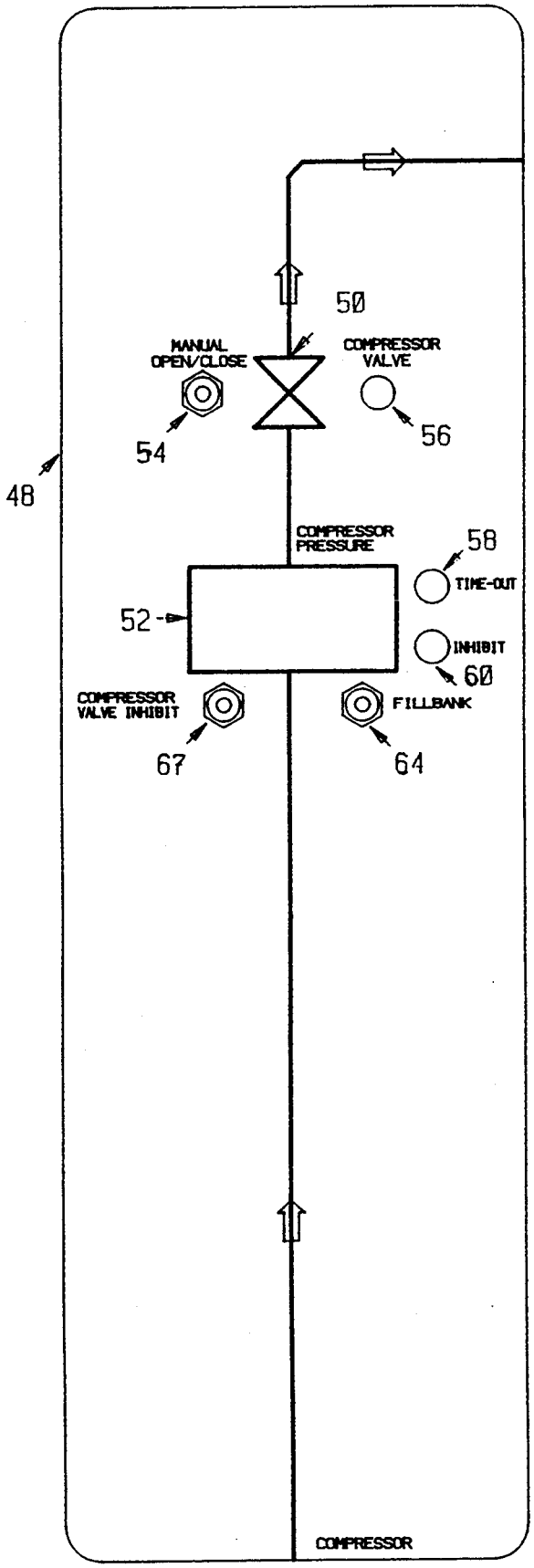
FIG. 3 is a front view of a compressor control panel included in the system of FIGS. 1 and 2.

FIG. 3 shows the control panel 48 for the compressor. The compressor control panel 48 includes a graphical representation 50 of the compressor valve and a digital display 52 for the compressor pressure. The microprocessor 30 repeatedly reads the pressure signal generated by the pressure transducer 26 on the compressor conduit 14 (FIG. 1), and provides a digital display of this pressure on the display 52.

The control panel 48 also includes a number of switches and displays. The manual open/close switch 54 allows the user to control the compressor valve manually. In the normal mode, the compressor valve is opened when the switch 54 is depressed and the compressor valve is closed when the switch 54 is released. In the manual override mode the switch 54 toggles the compressor valve between the open and the closed states with each closure. The compressor valve display 56 indicates the state of the compressor valve. This display 56 illuminates red when the valve is closed and green when the valve is open, and the display 56 is not illuminated when the valve is in an intermediate state. A time out display 58 illuminates when the compressor has not been called in the last 20 seconds, thereby indicating that the compressor override relay is active. The inhibit display 60 is illuminated when the compressor valve is in the inhibit mode.

The control panel 48 includes two additional user controlled switches. The compressor valve inhibit switch 62 allows the user to inhibit the compressor valve (and maintain it in the closed state) by pressing the switch 62. When the compressor valve is inhibited the display 52 will indicate all decimal points and the inhibit display 60 will be illuminated. A second press of the inhibit switch 62 re-enables the compressor valve.

The fill bank control switch 64 allows a user to command that all of the banks be filled with compressed air from the compressor to their maximum preset pressures.

Figure 4:
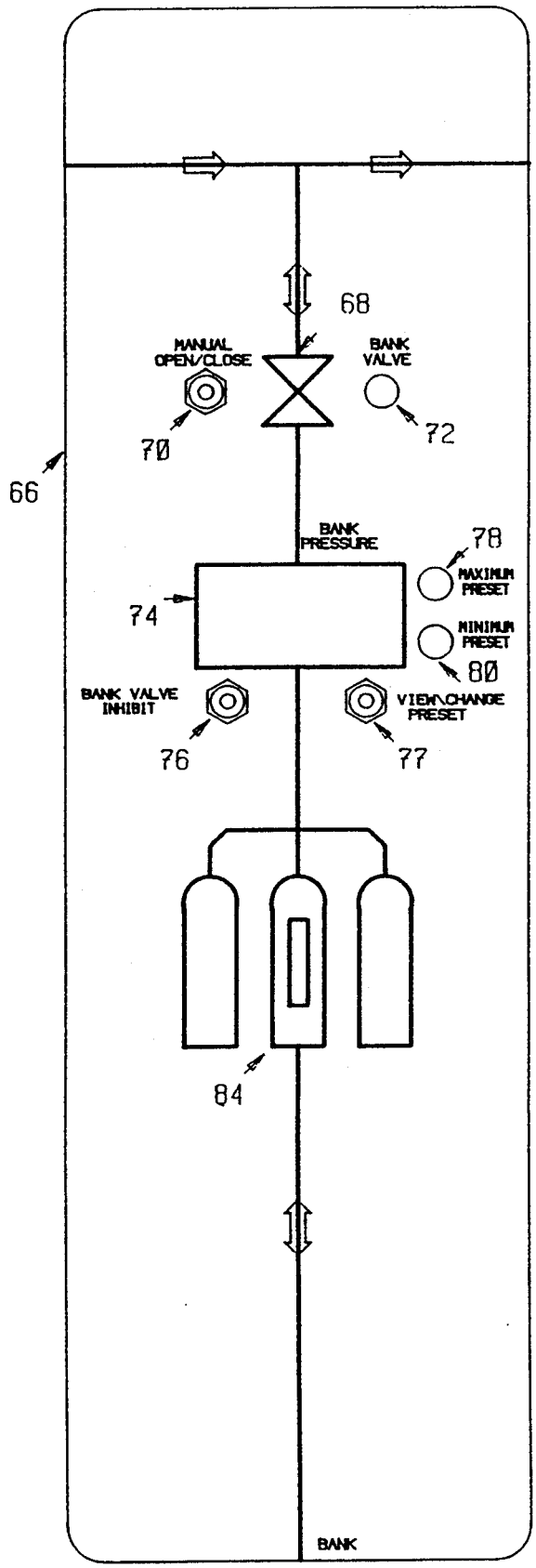
FIG. 4 is a front view of a bank control the tank filling system of FIGS. 1 and 2.

FIG. 4 is a front view of a control panel 66 for one of the banks. This control panel 66 includes a graphical representation 68 of the valve on the respective bank conduit. The manual open/close switch 70, the bank valve display 72, the digital display 74, and the bank valve inhibit switch 76 all function as described above in conjunction with FIG. 3, except that the various controls and displays relate to the respective bank conduit rather than the compressor conduit.

In addition, the digital display 72 can be used to display either the maximum preset pressure (when the maximum preset display 78 is illuminated) or the minimum preset pressure (when the minimum preset display 80 is illuminated). The view/change preset switch 77 is used by the user both to display and to change preset values for the respective bank. By pressing and releasing the switch 77 the current preset pressure is displayed. By pressing and holding the switch 77 the currently displayed preset pressure is reset to a minimum value and is then automatically incremented in steps. The user releases the switch 77 when the desired preset pressure is displayed. The displayed preset pressure will alternate between the maximum and the minimum preset pressures each time the switch 77 is depressed.

The panel 66 also includes a percent of fill indicator in the form of a bar graph 84. The microprocessor illuminates sufficient ones of the bars of the bar graph 84 to indicate how full (in percentage) the respective bank is based on the current pressure in the bank as compared to the maximum preset pressure for that bank.

Figure 5:
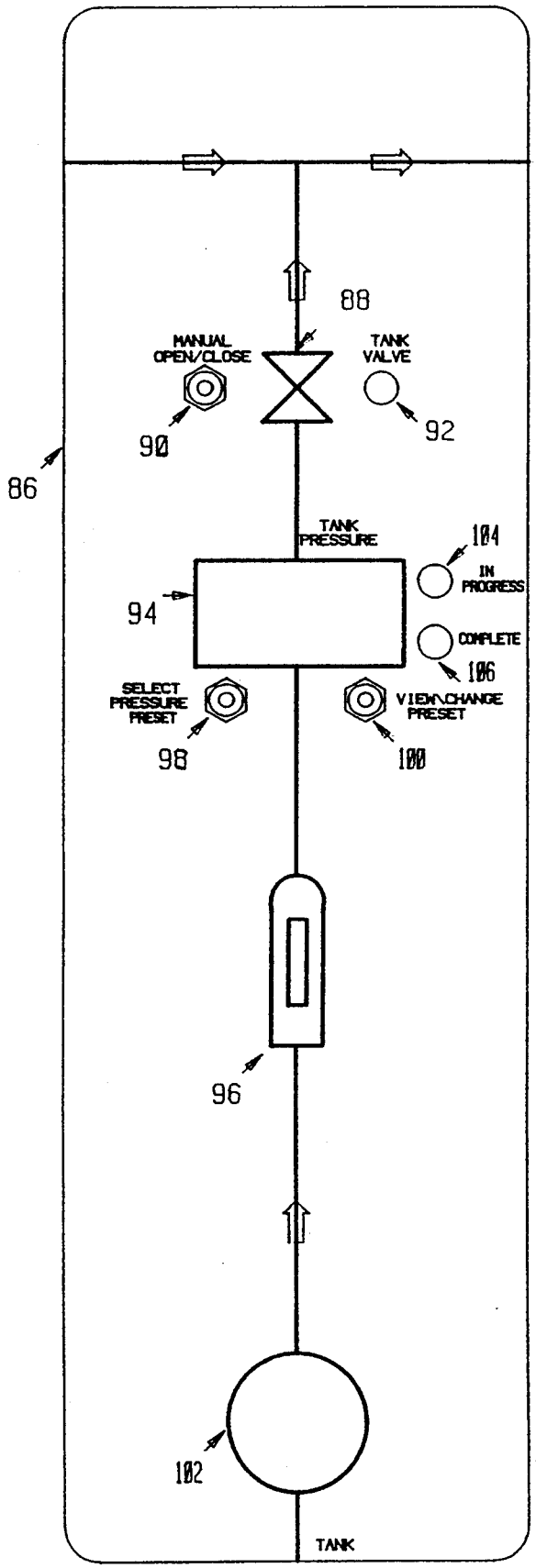
FIG. 5 is a front view of a tank control panel of the system of FIGS. 1 and 2.
Figure 6:
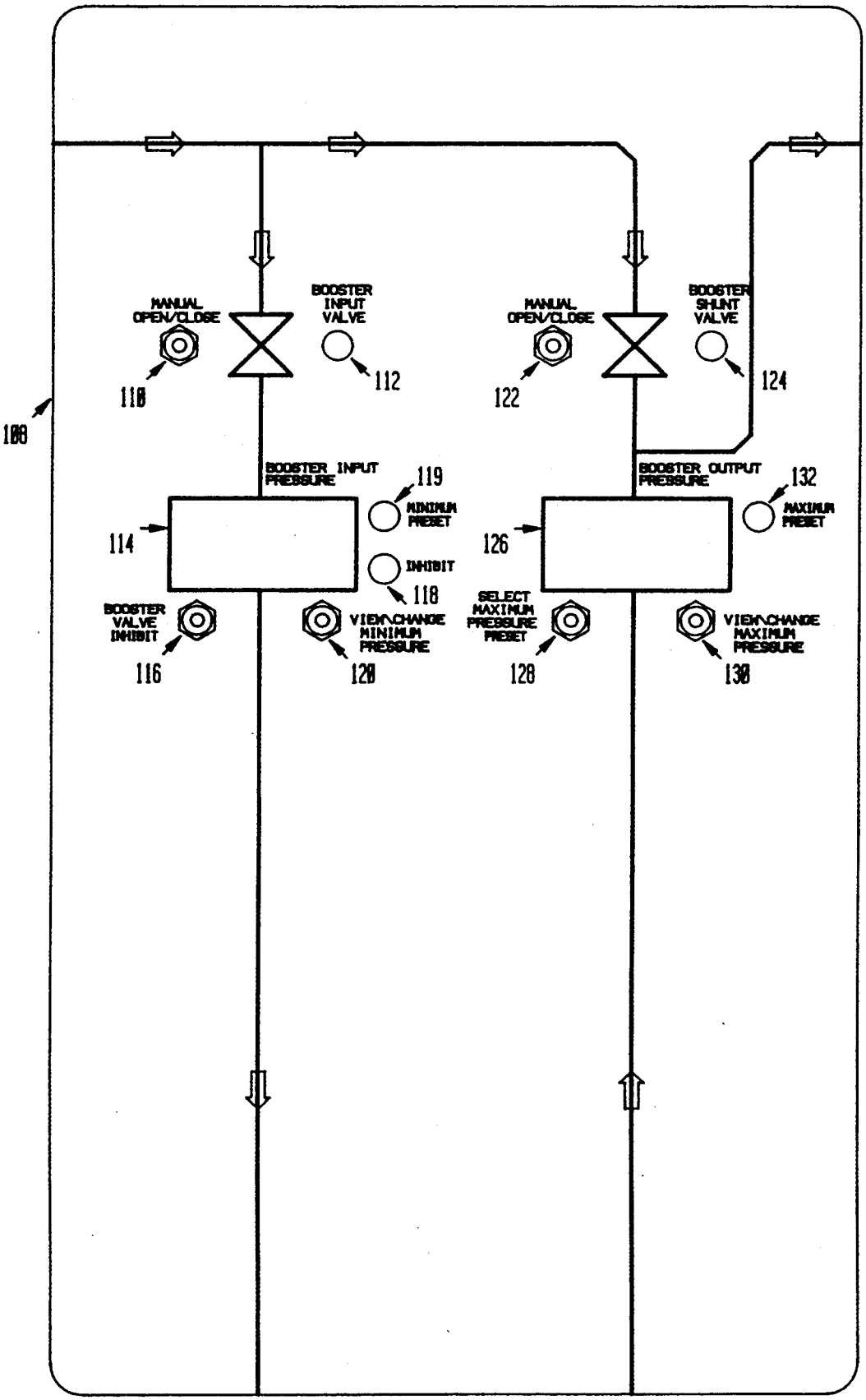
FIG. 6 is a front view of a booster pump control panel of the system of FIGS. 1 and 2.

FIG. 5 shows a control panel 86 for a tank to be filled. This control panel includes a graphical representation 88 of the respective tank valve. In addition, the control panel 86 includes a manual open/close switch 90, a tank valve display 92, a digital display 94, and a bar graph 96 which relate to the respective fill conduit valve and pressure transducer, but otherwise function as described above.

The control panel 86 allows a user to set a pressure set point, which defines the pressure to which the tank is to be filled. The switch 98 allows a user to select one of eight preprogrammed pressure set points. Each press of the switch 98 advances to the next preset value in the sequence. The user can also view and change the pressure set point with the switch 100. When the switch 100 is pressed and released the current pressure set point is displayed on the digital display 94. When the switch 100 is pressed and held, the pressure set point is reset to a minimum value and then increased in steps. The user simply releases the switch 100 when the desired pressure set point is displayed.

Once a pressure set point has been established and a tank has been connected to a fill conduit, the user can start the filling operation by depressing the fill switch 102. A first press of the fill switch 102 starts the filling process, and a subsequent press aborts a filling process still in progress. The displays 104, 106 indicate the fill status. In particular, the display 104 is illuminated when the tank is being filed, or is in the queue to be filled. The display 106 is illuminated when the tank has been filled to the pressure set point.

FIG. 5 shows a booster pump control panel 108. A manual open/close switch 110 and a booster input valve display 112 allow a user to control and learn the state of the flow control valve on the booster pump inlet conduit, all as described above. The digital display 114 displays the pressure in the booster pump inlet conduit 18.

The switch 116 allows a user to inhibit opening of the valve on the booster pump inlet conduit, and when the valve is so inhibited the inhibit display 118 is illuminated. A second press of the switch 116 restores the valve on the booster pump inlet conduit to normal operation.

The display 114 normally shows the actual pressure in the booster inlet conduit. To view the minimum pressure preset for this conduit, the user presses the view/-change preset switch 120 momentarily. In response, the display 114 shows the current minimum pressure preset for three seconds and then returns to displaying the actual input pressure. To set or change the minimum pressure preset, the switch 112 is held down for three seconds. This causes the minimum pressure preset to be reset to zero and then incremented in steps, as displayed on the display 114. The user releases the switch 120 when the desired minimum pressure preset is displayed.

The booster pump control panel 108 also includes a manual open/close switch 122, a booster shunt valve display 124 and a booster output pressure display 126, which operate as described above in conjunction with related components of the other control panels.

In addition, the control panel 108 allows the user to select a preset value for the maximum pressure. Eight preset pressures are available and each press of the switch 128 causes the next preset maximum pressure in the sequence to be displayed.

The display 126 normally shows the actual output pressure of the booster pump. To view the current maximum pressure preset, the user presses the view/-change maximum pressure switch 130 momentarily. This causes the display 126 to show the current maximum pressure preset for three seconds, before returning to a display of the booster pump output pressure. To adjust the maximum pressure preset, the user holds down the view/change maximum pressure switch 130 for three seconds. This causes the maximum pressure preset to reset to zero and then increase in steps. The user releases the switch 130 when the desired maximum pressure preset is displayed. The display 132 is illuminated whenever the display 126 is displaying the maximum preset rather than the booster pump output pressure.

Figure 7:
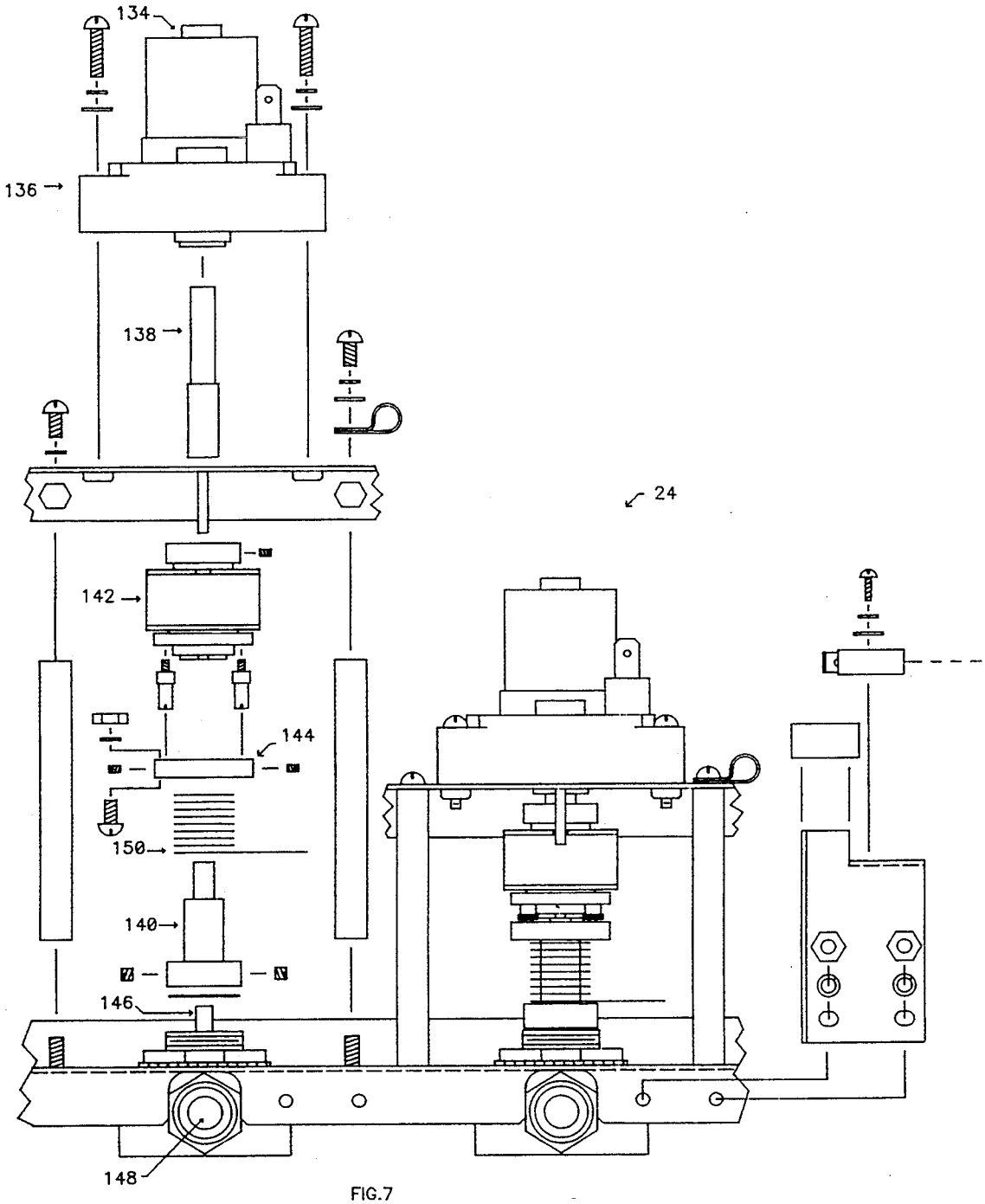
FIG. 7 is a side view shown partially exploded of a flow control valve included in the system of FIGS. 1 and 2.
Figure 8:
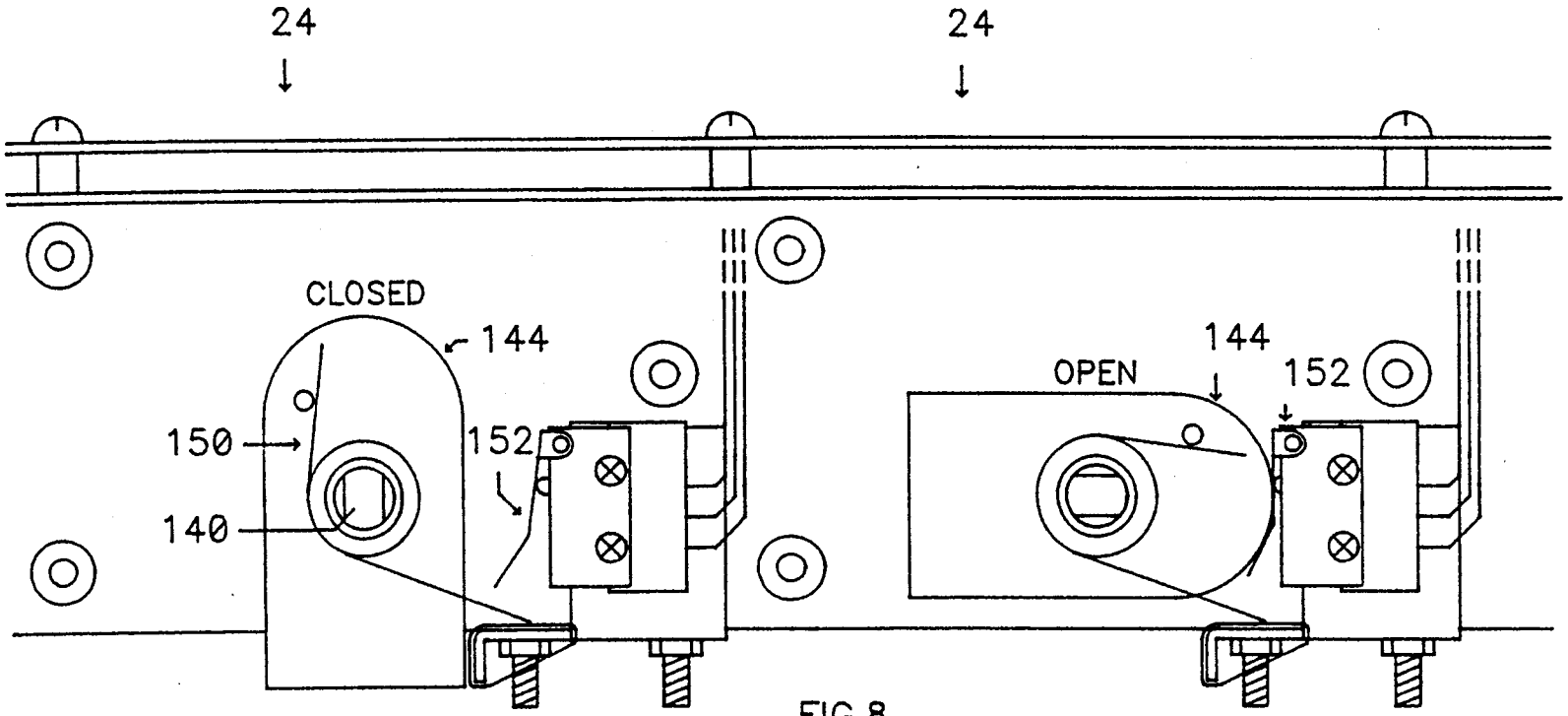
FIG. 8 is a sectional view taken along line 8—8 of FIG. 7.

Turning now to FIGS. 7 and 8, these drawings show two views of two of the valves 24. In this embodiment all of the valves 24 are identical, and as explained above they have been designed for use with dry compressed air up to pressures of 6,000 psi. Of course, these valves could readily be modified as appropriate for use with other gases, or for use at other pressures.

As best shown in the exploded view on the left hand side of FIG. 7, each of the valves 24 includes an electric motor 134 which rotates a motor shaft 138 via a gear box 136. The motor shaft 138 is coupled to a mandrel 140 by an electromagnetic clutch 142. The clutch 142 when energized couples the motor shaft 138 to the mandrel 140 such that they rotate in unison. When power is removed from the clutch 142, the mandrel 140 is free to rotate independently of the motor shaft 138. A cam 144 is secured to the mandrel 140 as for example by set screws, and the mandrel 140 is secured to the actuating shaft 146 of a ball valve 148. The ball valve 148 is a 90° rotation on/off valve. That is, rotation of the actuating shaft 146 by 90° is sufficient to move the ball valve 148 from the open to the closed position and vice versa.

A torsion spring 150 is positioned around the mandrel 140 to bias the ball valve 148 to the closed position with sufficient force such that the ball valve 148 is automatically closed whenever the clutch 142 is deenergized. FIG. 8 shows the manner in which the cam 144 cooperates with a limit switch 152 such that the limit switch 152 indicates the state of the valve. When the valve is in the open position as shown on the right hand side of FIG. 8, the cam 144 contacts the limit switch 152, thereby causing the limit switch 152 to change state. In all other positions-of the valve 148 the limit switch 152 is in the other position, as shown for example on the left hand side of FIG. 8.

The motorized valve shown in FIGS. 7 and 8 provides advantages in this application. In particular, the motor 134 and the gear box 136 ensure that the ball valve 148 is opened in a gradual and progressive manner, thereby reducing the thermal and physical shock associated with valve opening. In this preferred embodiment approximately 2.5 seconds are required for the motor 134 to move the ball valve 148 from the fully closed to the fully open position. This is accomplished by simultaneously providing power both to the motor 134 and to the clutch 142.

Once the ball valve 148 has reached the open position, as indicated by the limit switch 152, the motor 134 will be deenergized. As long as power is applied to the clutch 142, the ball valve 148 is held in the open position by the drag exerted by the deenergized motor 134 and gear box 136.

When it is desired to close the valve 148 (or in the event of a power failure), power is removed from the clutch 142. Once the clutch 142 disconnects the mandrel 140 from the motor shaft 138, the biasing force applied by the spring 150 quickly closes the ball valve 148. Thus, the arrangement shown in FIGS. 7 and 8 closes the ball valve 148 in a high speed, fail-safe manner, whenever power is removed from the clutch 142.

Turning now to FIGS. 9 through 30, these figures provide flow charts of the program executed by the microprocessor 30. The following discussion of selected aspects of the software flowcharted in FIGS. 9 through 30 provides a general overview of the structure and operation of the program.

Figure 9:
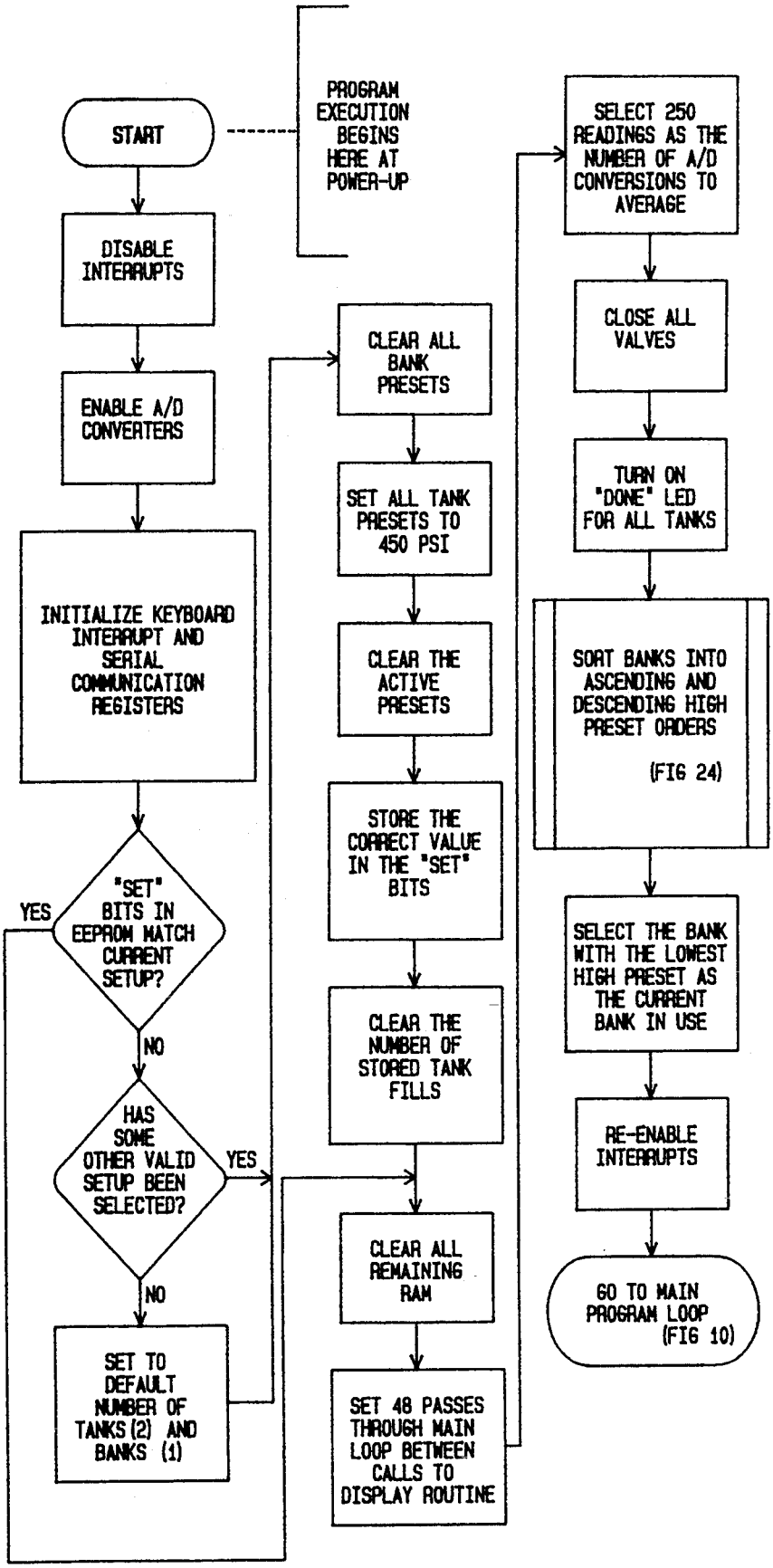
FIGS. 9 through 30 are flow charts of various control modules executed by the microprocessor shown in the electrical block diagram of FIG. 2.

When power is applied to the microprocessor 30, execution begins with the routine of FIG. 9. After the initialization steps set out in FIG. 9 control branches to the main program loop of FIG. 10.

Figure 10A:
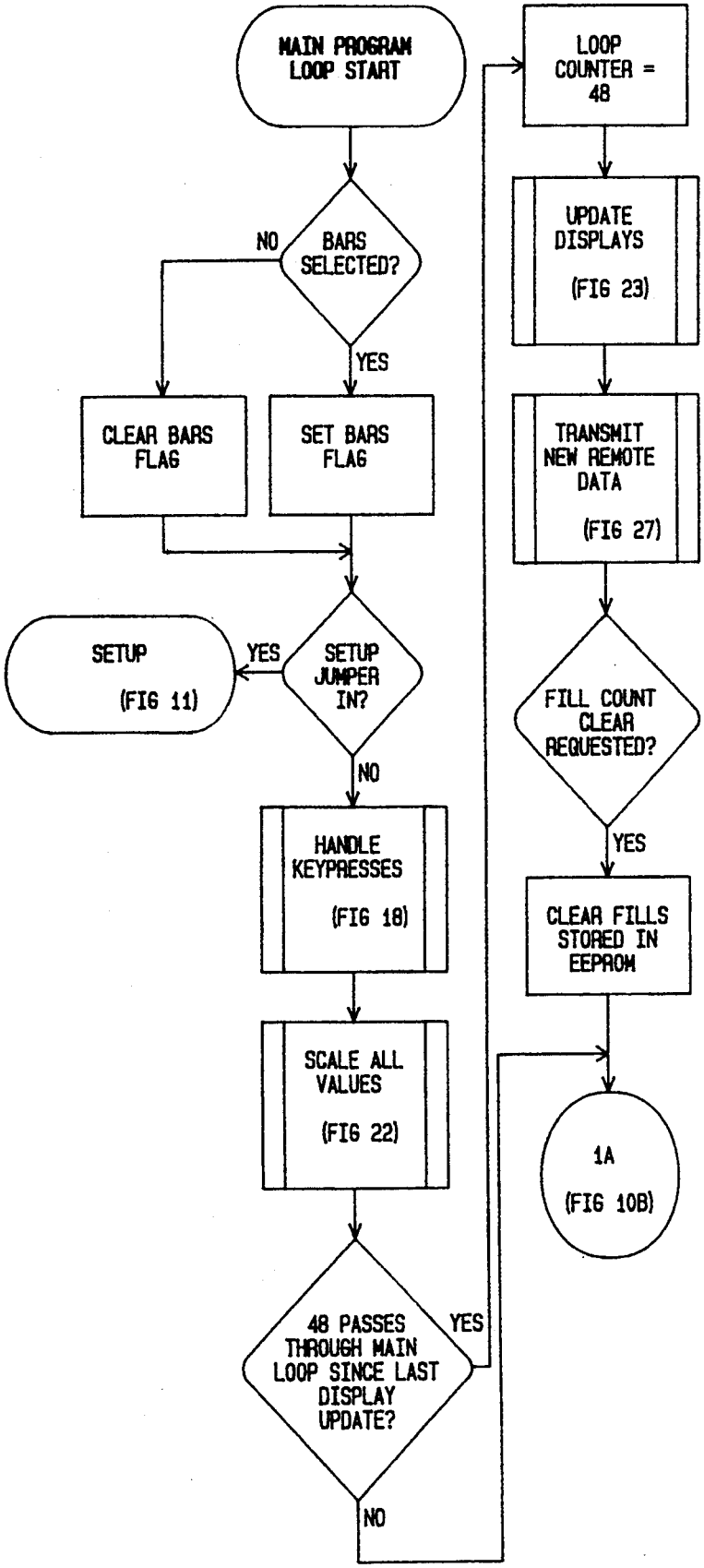
Figure 10B:
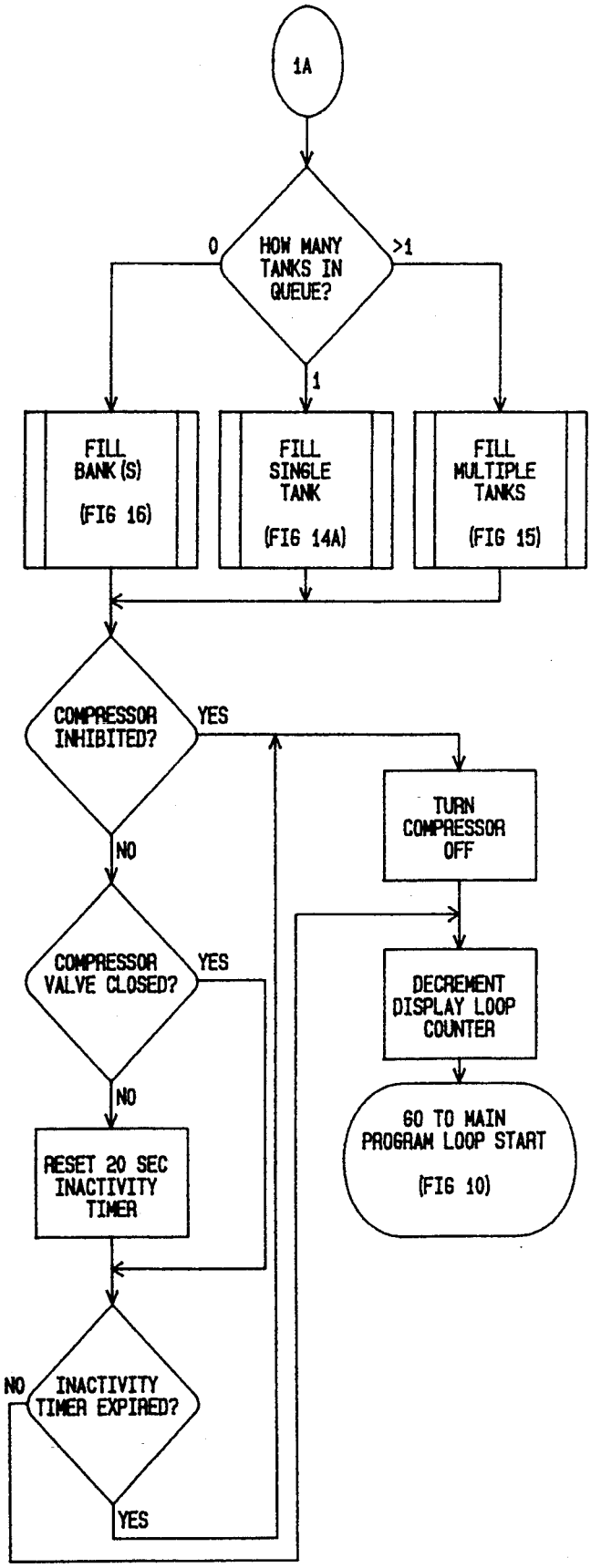
Figure 11:
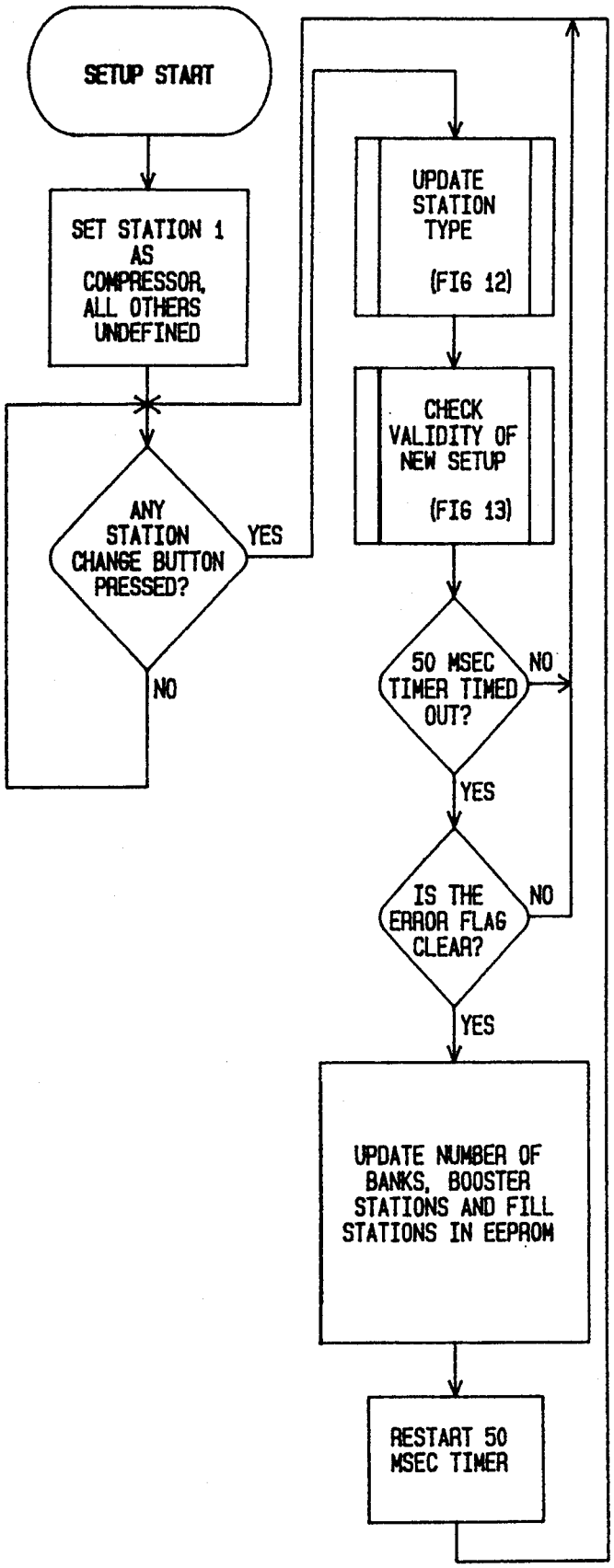
Figure 12:
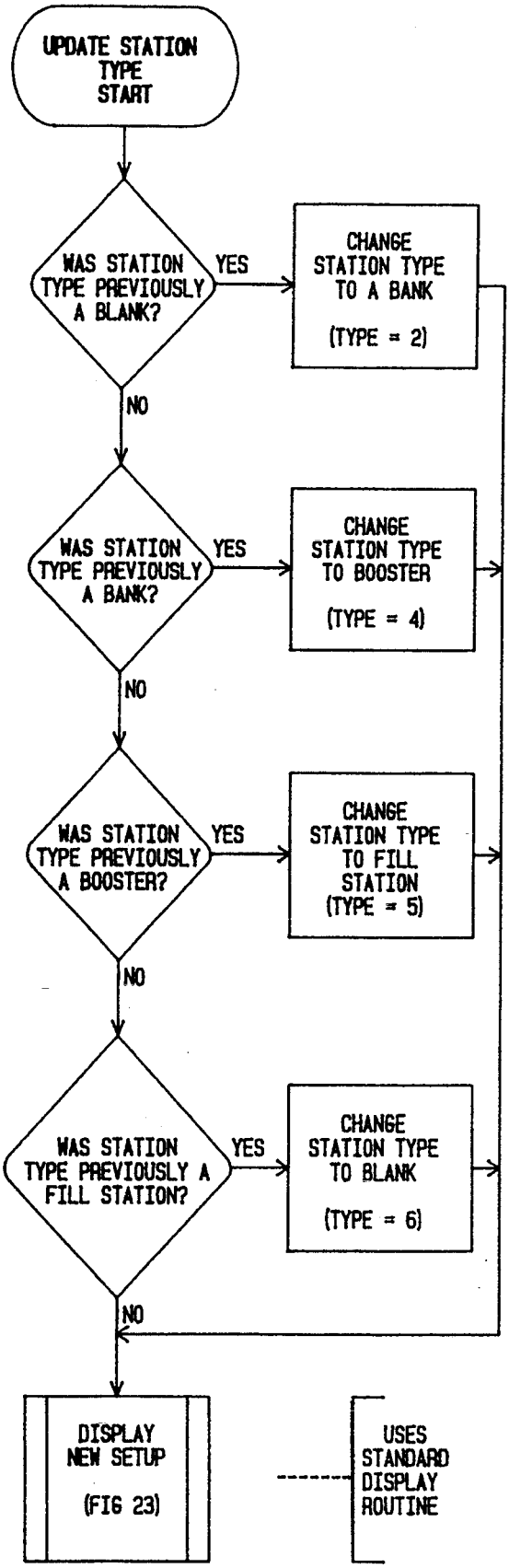
Figure 13:
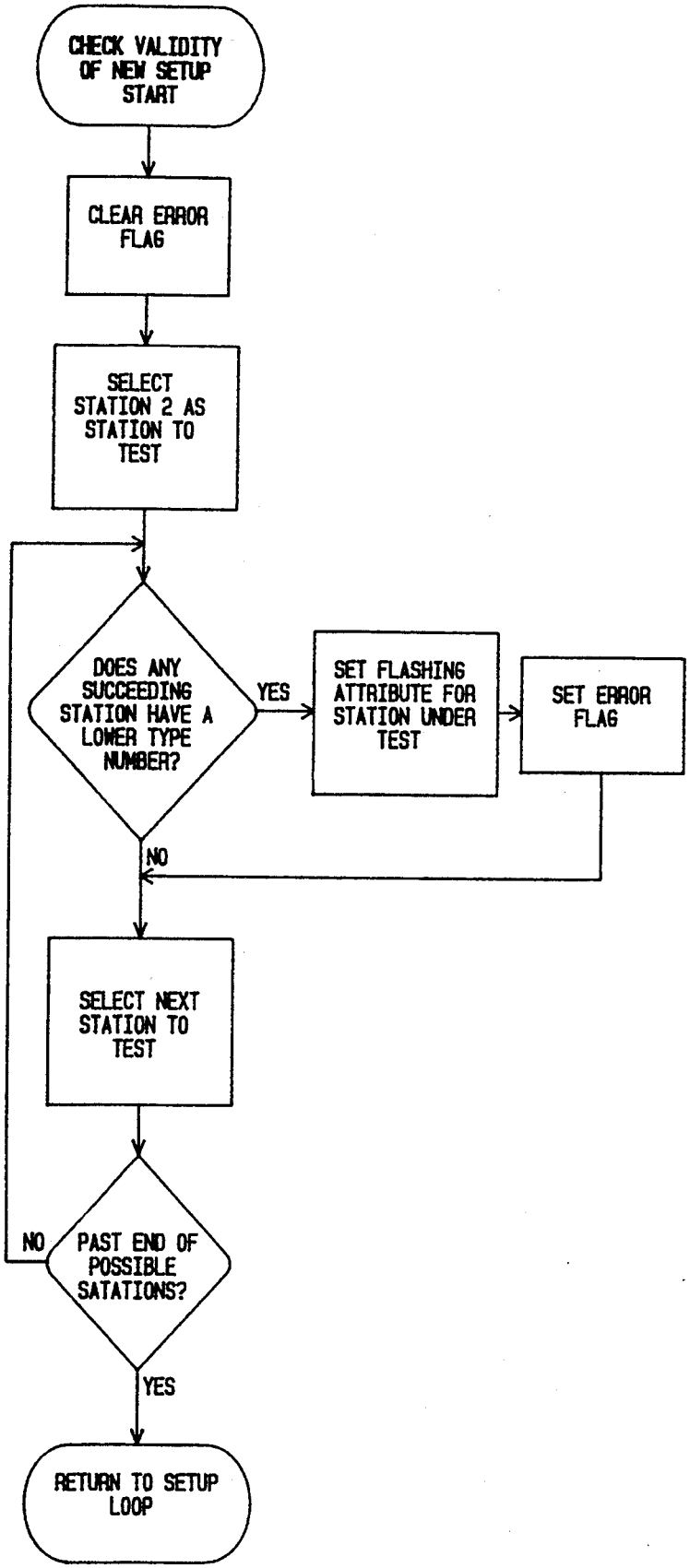

During an initial pass through the main program loop of FIG. 10 when the set-up jumper is installed, the set-up routine of FIG. 11 is executed. The set-up routine shown in FIG. 11 calls the update to next station type routine of FIG. 12, and the check validity of new set-up routine of FIG. 13. Taken together the routines of FIGS. 11, 12 and 13 set up the microprocessor 30 by properly identifying the nature of each of the modules included in the system. The first module (to the left hand side of the control panel) is assumed to be a compressor module as shown in FIG. 3. The remaining modules are identified to allow proper system operation.

Figure 18:
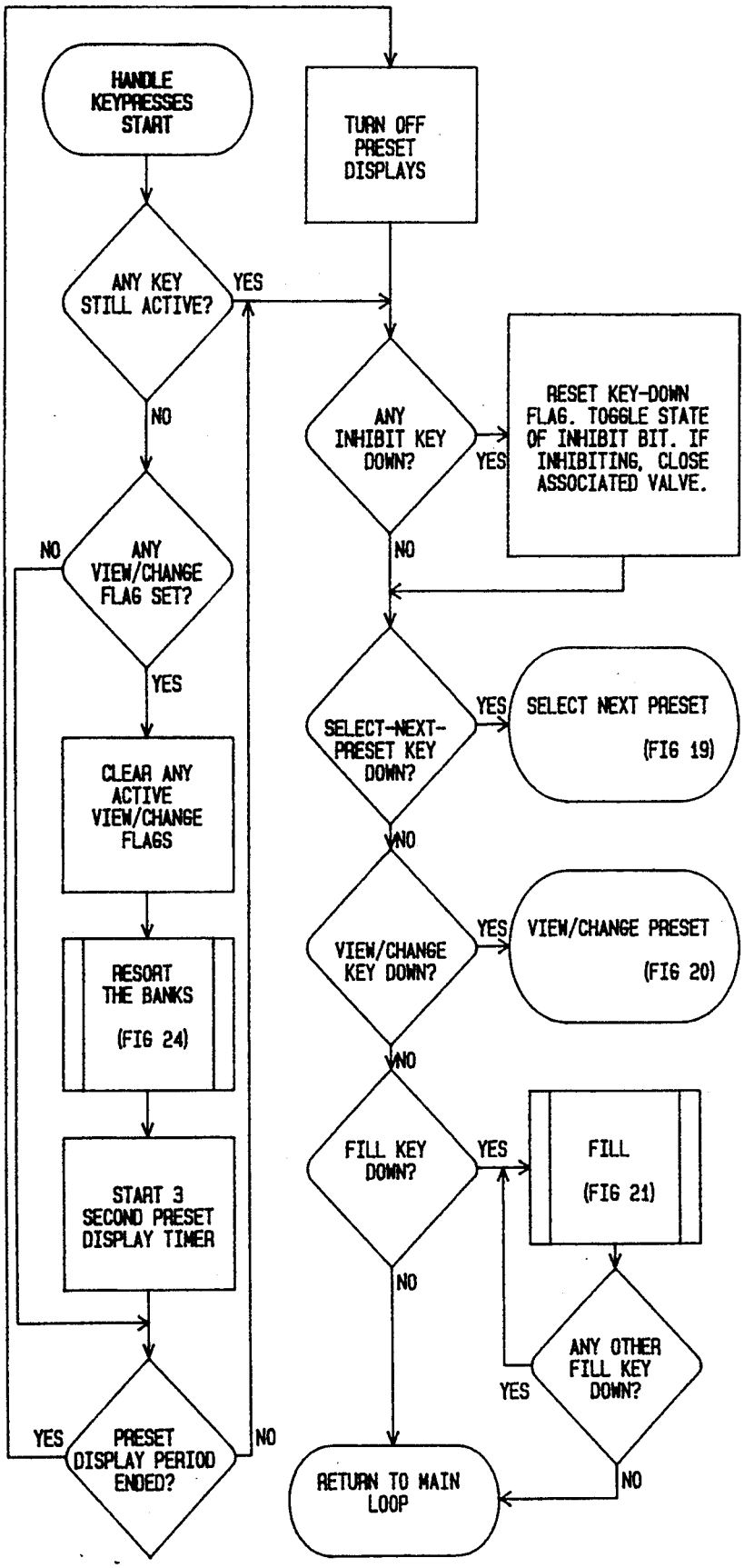
Figure 19:
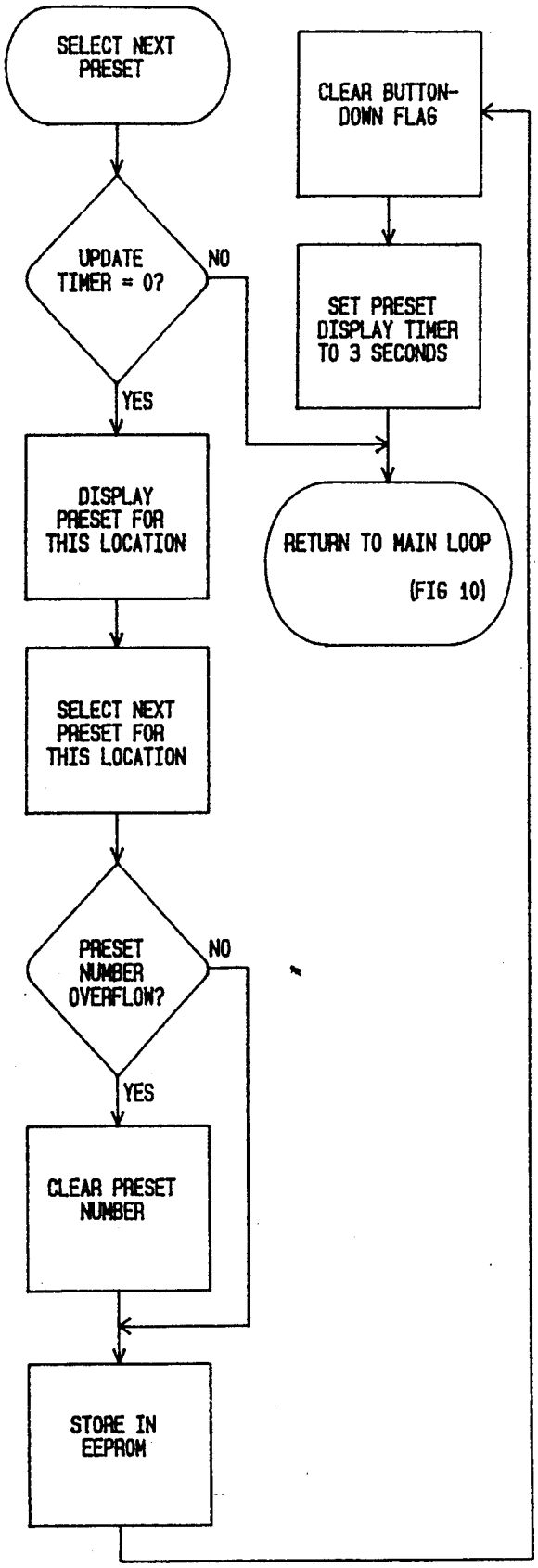
Figure 20:
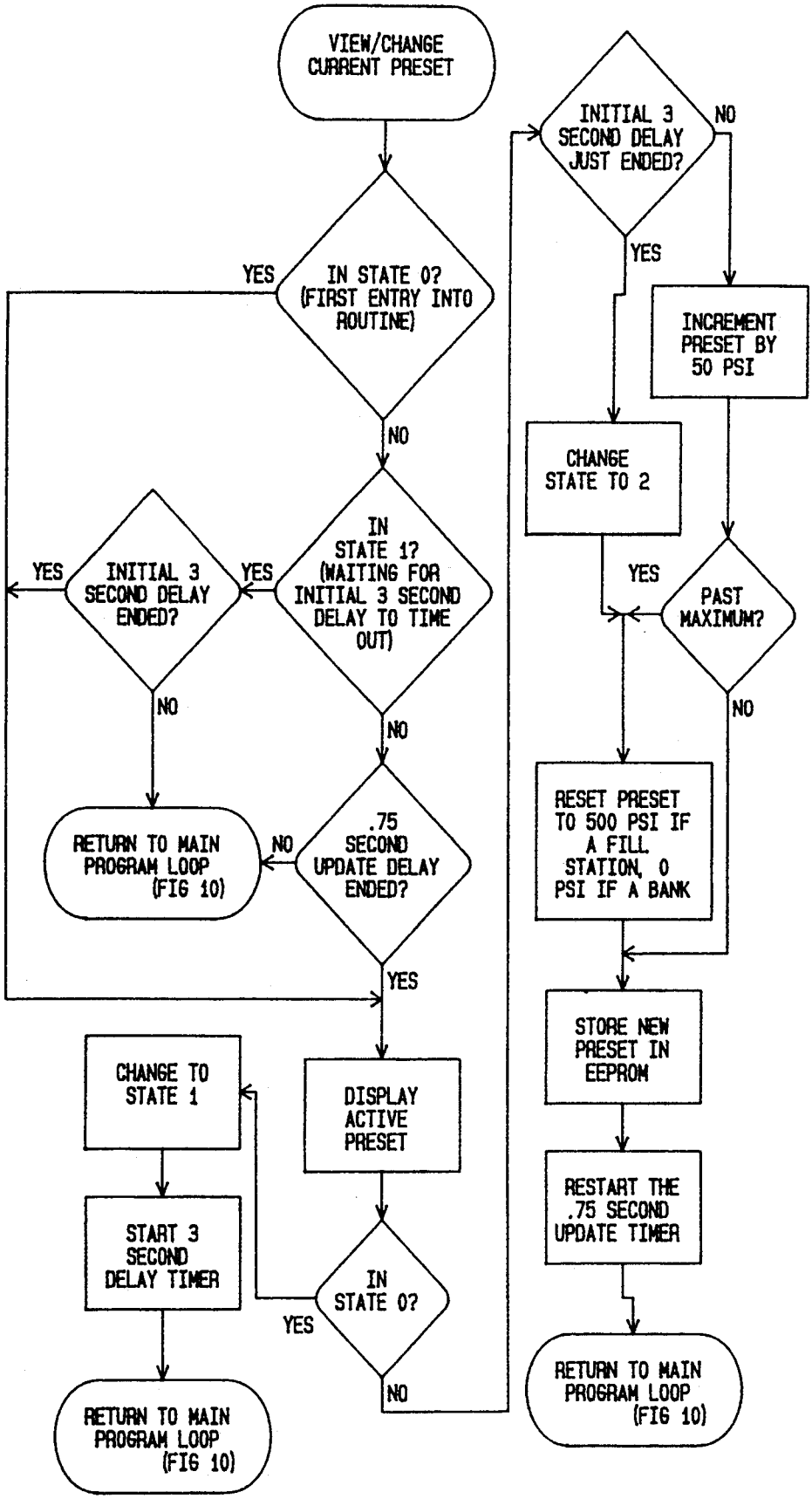
Figure 21:
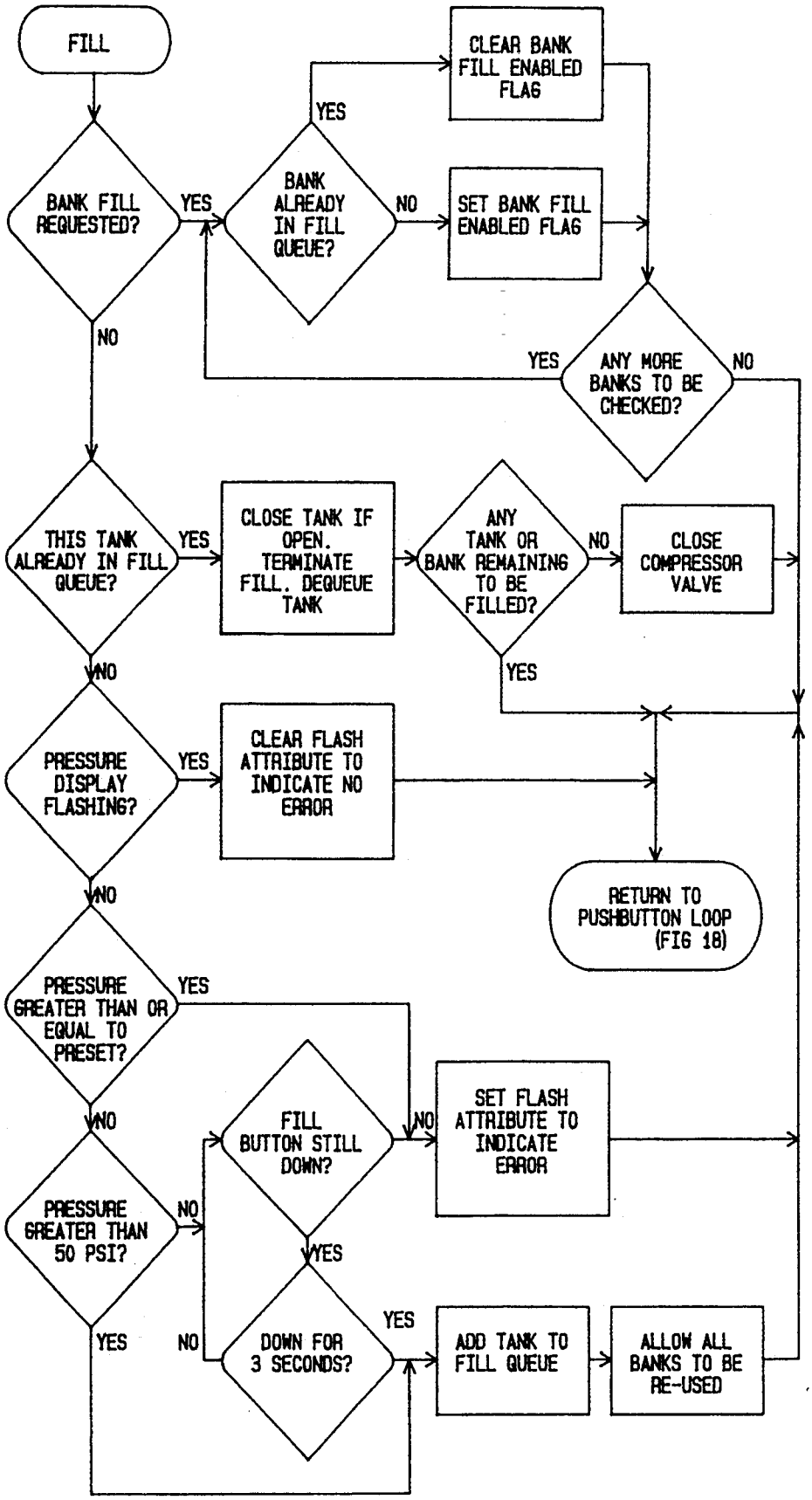

Returning to FIG. 10, if the setup jumper is not installed, the main program loop then processes key presses using the routine of FIG. 18. The program of FIG. 18 responds to push button closure to select a preset to be adjusted (using the program of FIG. 19), and to view or change the preset (using the routine of FIG. 20). In the event a fill key is depressed, the routine of FIG. 21 is executed. This routine responds both to the switch 64 (FIG. 3) requesting that the banks be filled, and to switches 102 (FIG. 5) requesting that one or more tanks be filled.

The microprocessor 30 maintains a fill queue for both tanks and banks to be filled. The program of FIG. 21 sets a fill enabled flag for each bank when the bank is requested to be filled using the switch 64 (FIG. 3). In addition, the routine of FIG. 21 adds a tank to the queue in response to the depression of one of the fill switches 102 (FIG. 5). Note that in the control module flowcharted at the lower left-hand corner of FIG. 21, the routine checks to determine that the pressure in the fill conduit 22 is greater than 50 psi. If so, the tank is added to the fill queue and control is returned to the push button loop. Otherwise, the routine requires that the operator hold the fill switch 102 down for at least three seconds before adding the tank to the fill queue. This control module provides an important safety precaution. In the event the fill switch 102 is depressed while the fill conduit 22 is unconnected to a tank, it could be dangerous to supply high pressure air to the fill conduit. The control module flow charted in FIG. 21 prevents the valve 24 in the fill conduit 22 from being opened inadvertently until after the fill conduit 22 has been connected to a tank, and the tank valve has been opened. It is only under these conditions that the measured pressure in the fill conduit 22 will exceed 50 psi.

Figure 22:
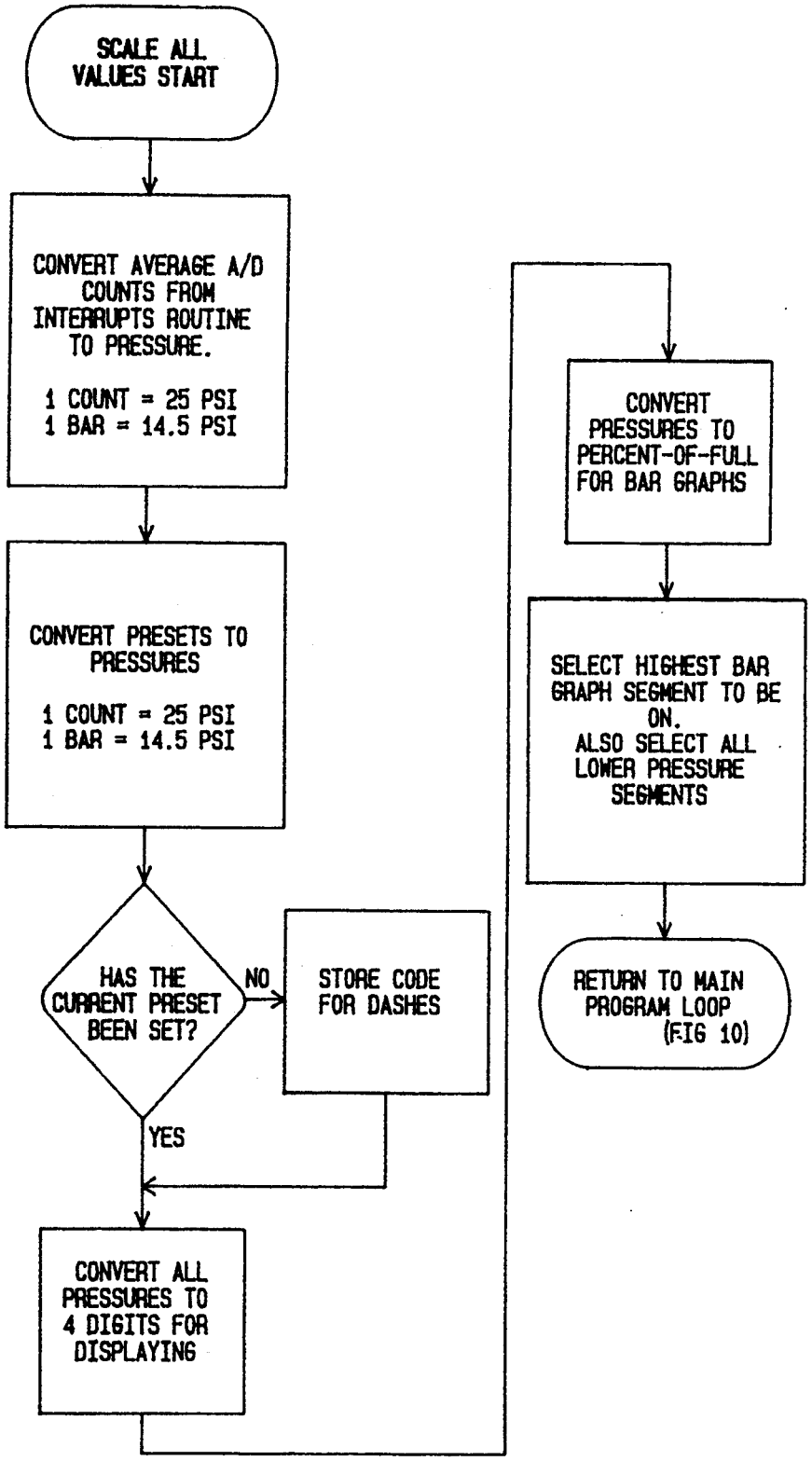
Figure 23:
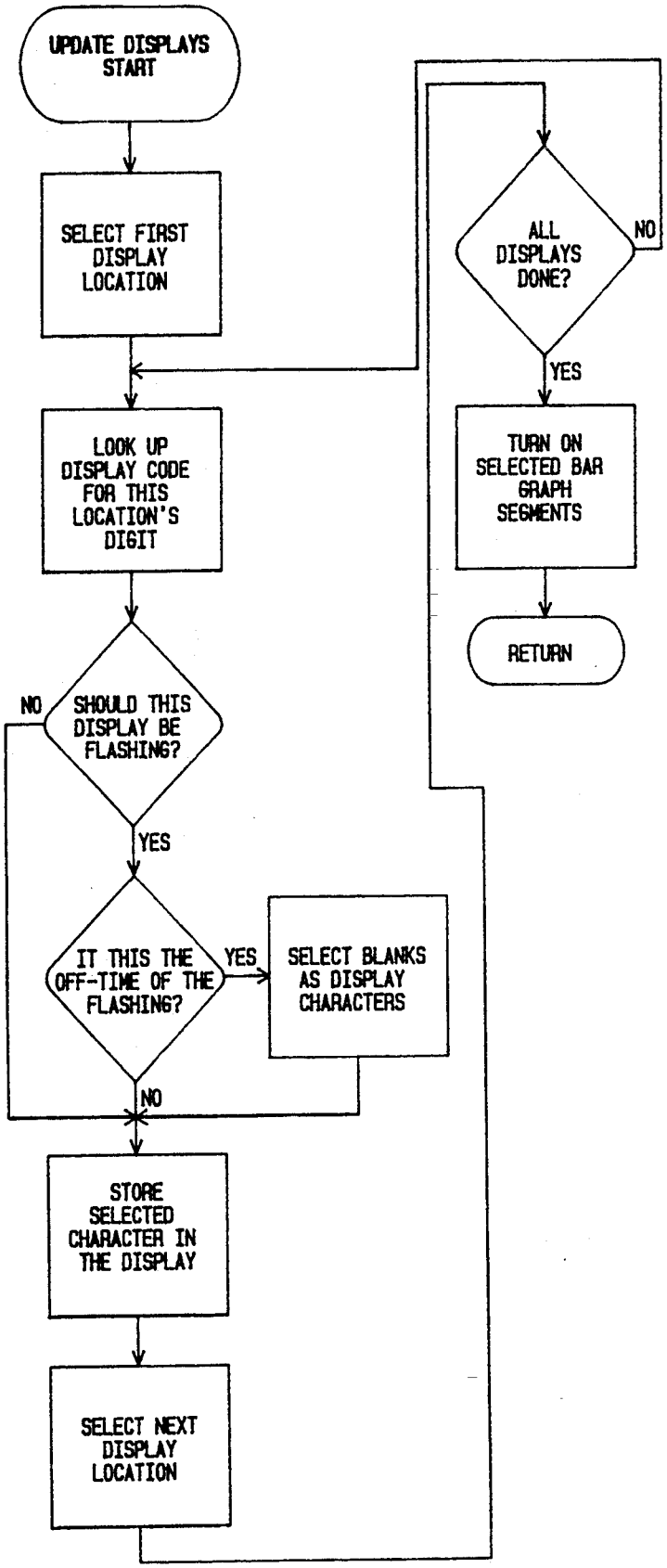
Figure 24:
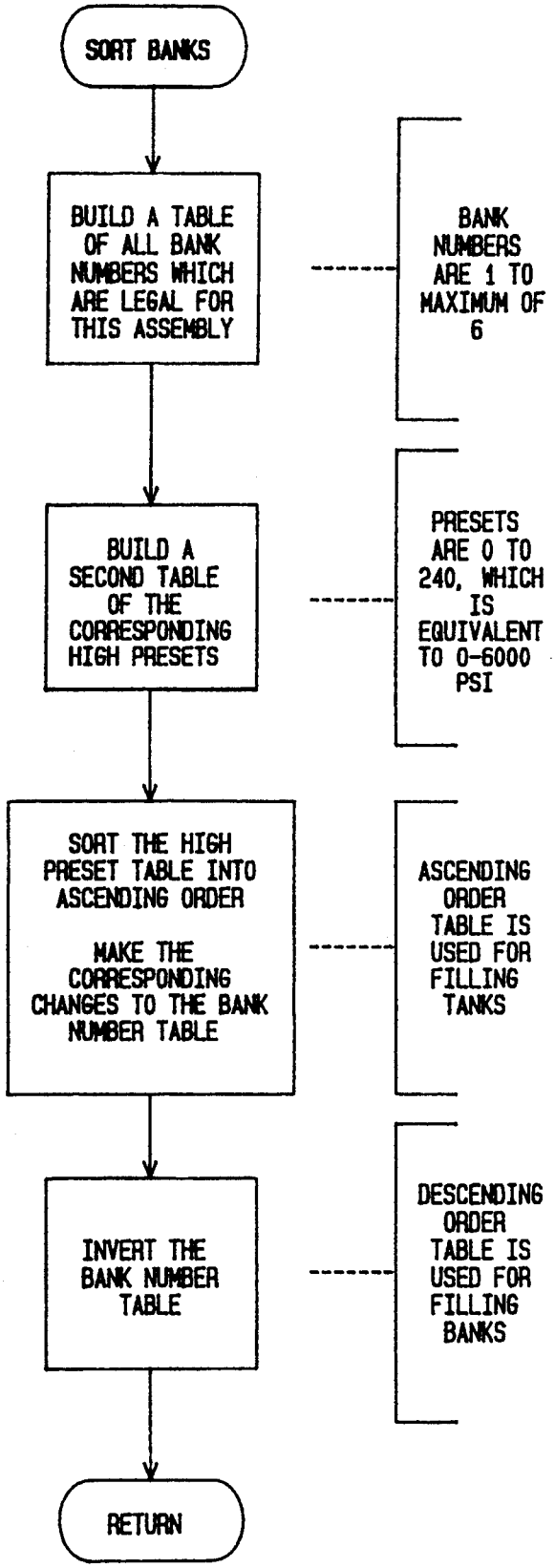
Figure 27:
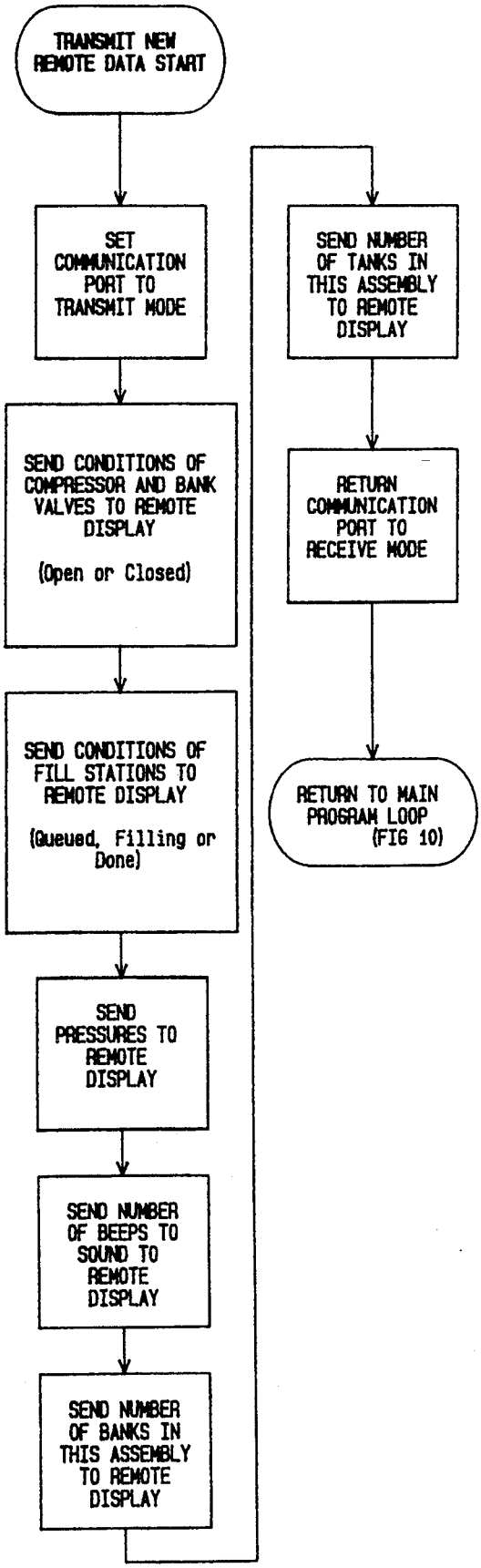
Figure 28:
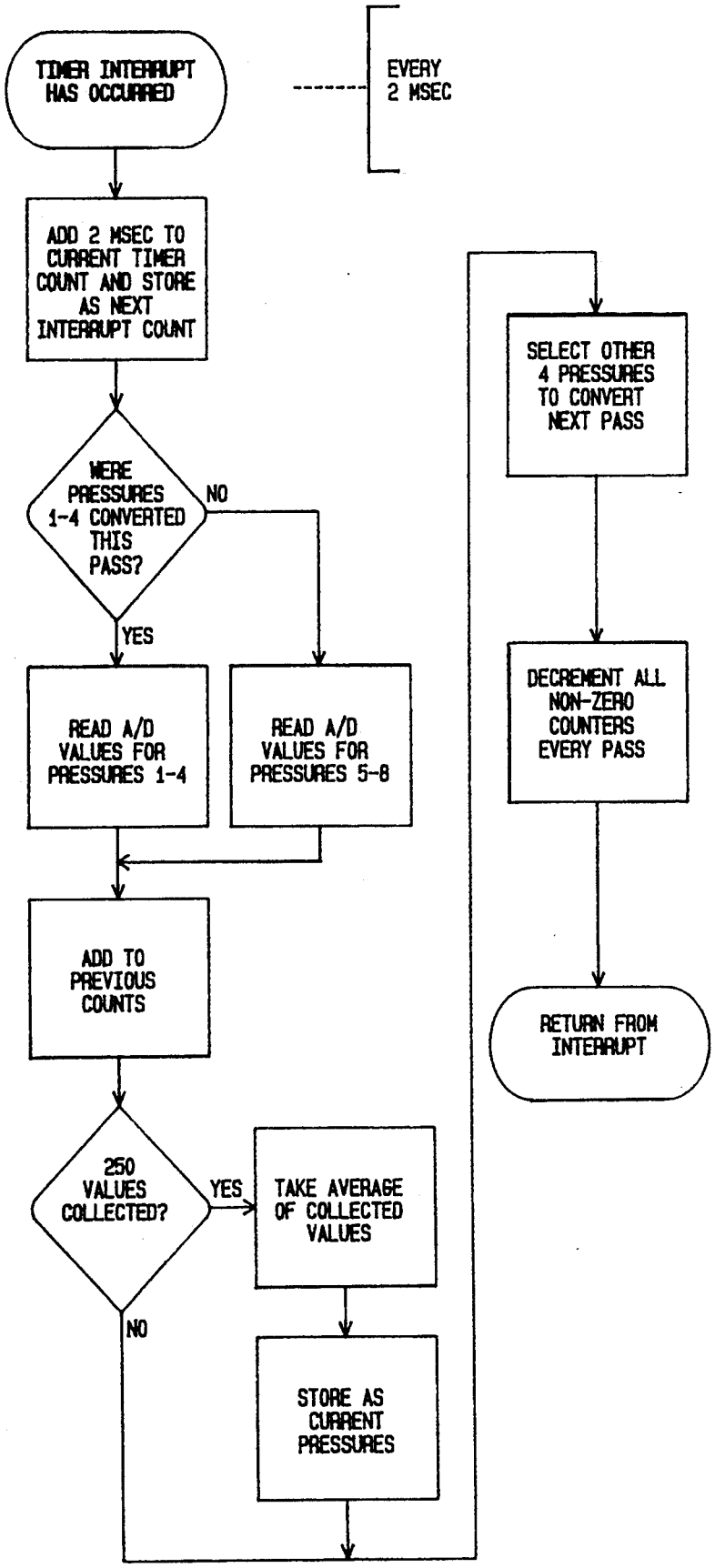
Figure 29:
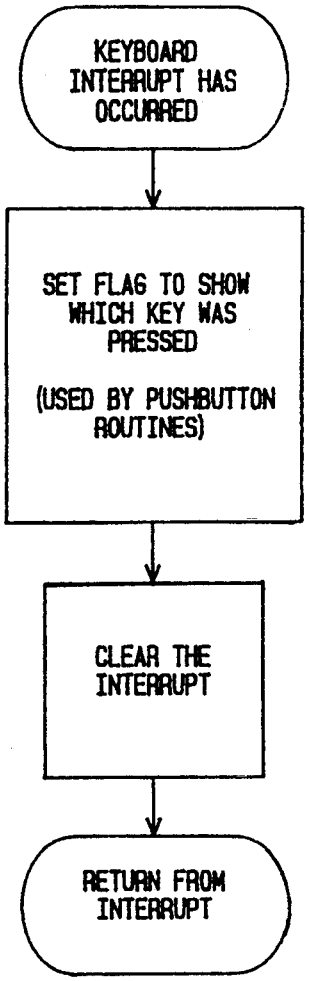
Figure 30:
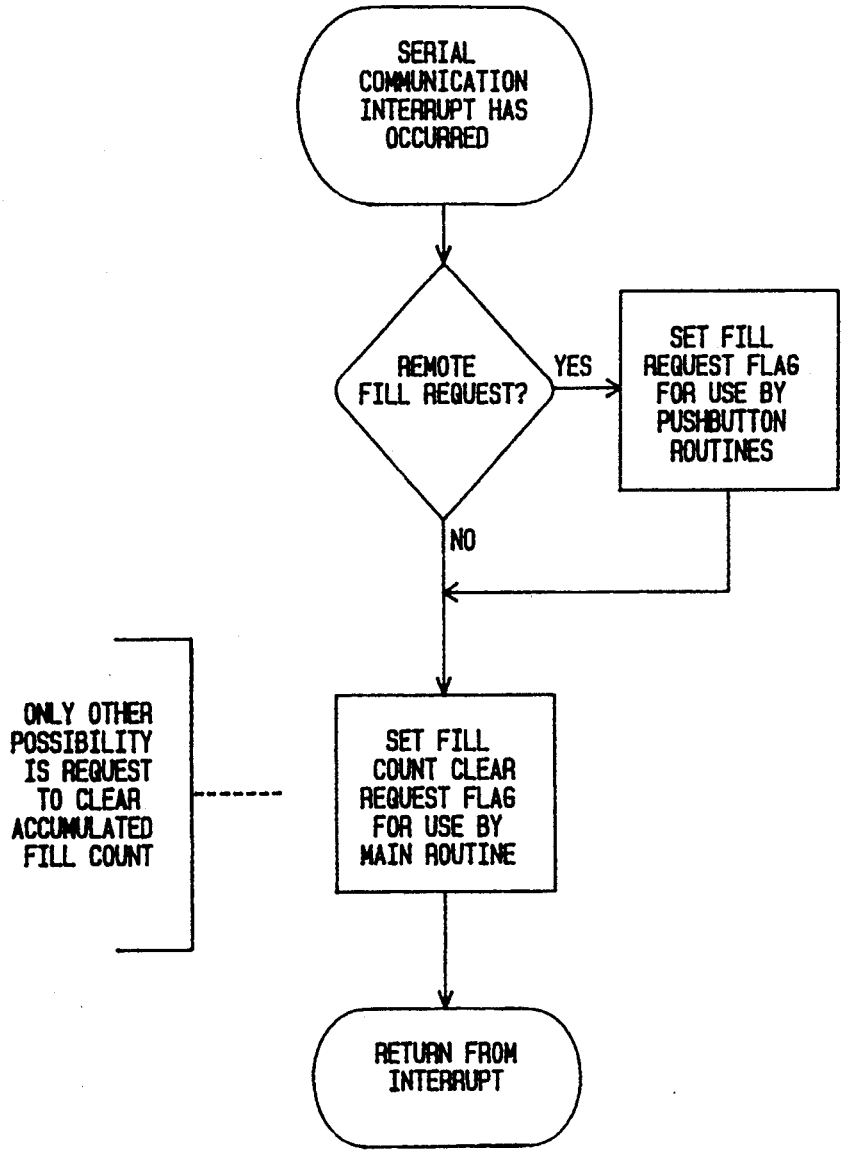

Returning to the main program loop (FIG. 10), the routine scales values using the routine of FIG. 22, updates displays using the routine of FIG. 23, and calculates and outputs new remote data using the routine of FIG. 27. The routine then checks to determine how many tanks are in the fill queue to be filled. In the event the number of tanks in the fill queue is 0, control branches to the fill banks routine of FIG. 16. In the event the number of tanks in the fill queue is equal to 1, control branches to the fill single tank routine of FIGS. 14A, 14B and 14C. In the event multiple tanks are in the fill queue, control branches to the fill multiple tanks routine of FIG. 15. The main program loop then checks to determine if the compressor valve has been closed for 20 seconds or more. If so, the compressor is turned off and control returns to the start of the main program loop.

Figure 14A:
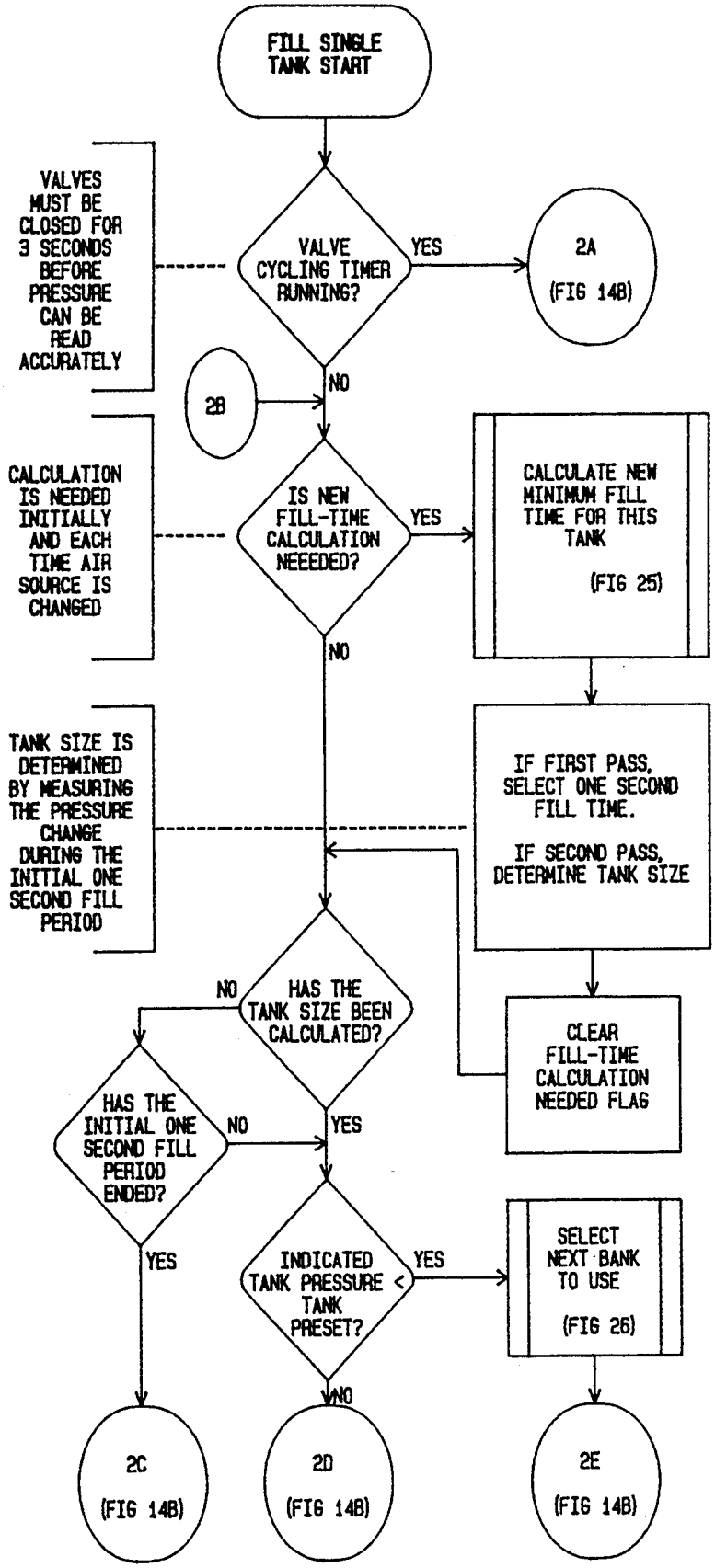
Figure 14B:
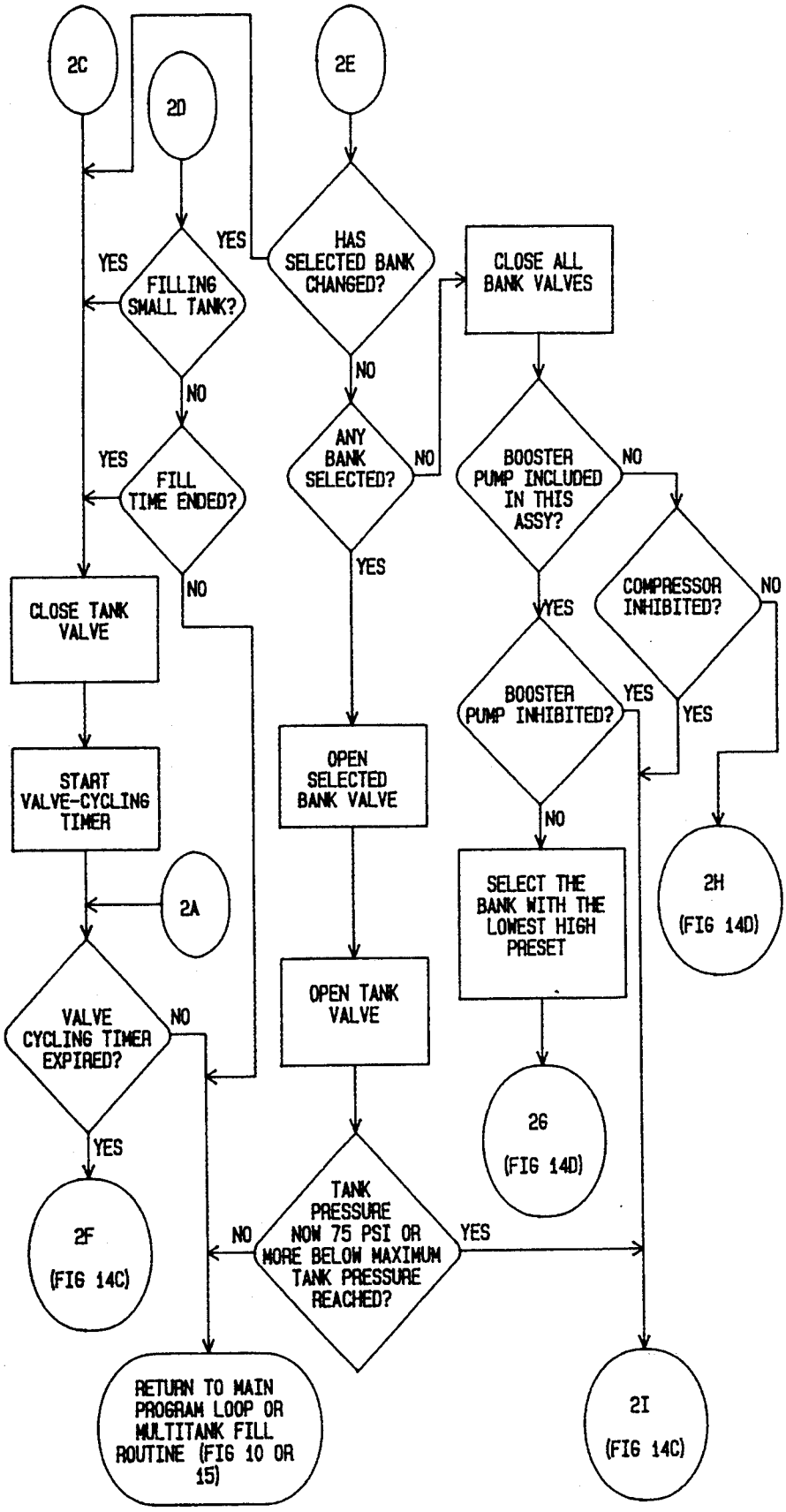
Figure 14C:
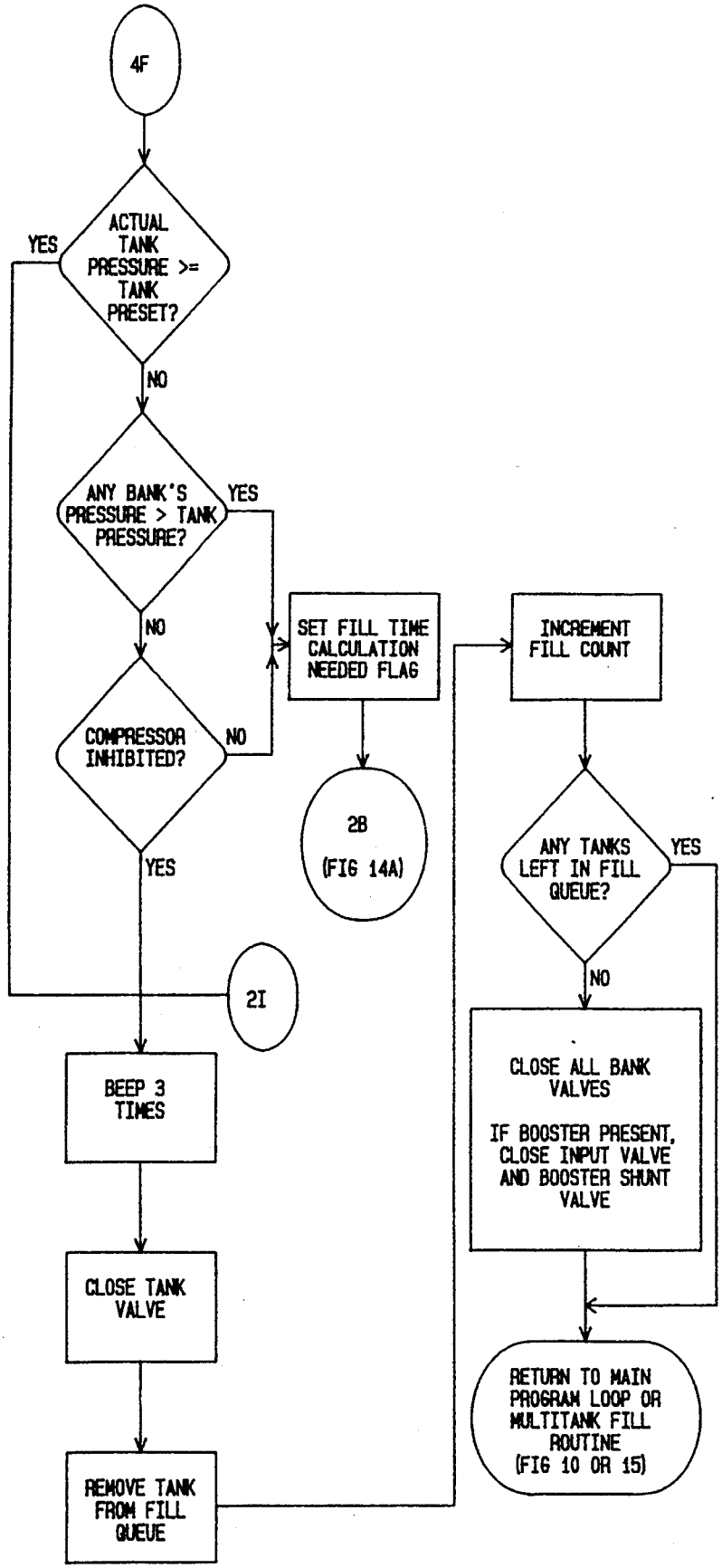
Figure 14D:
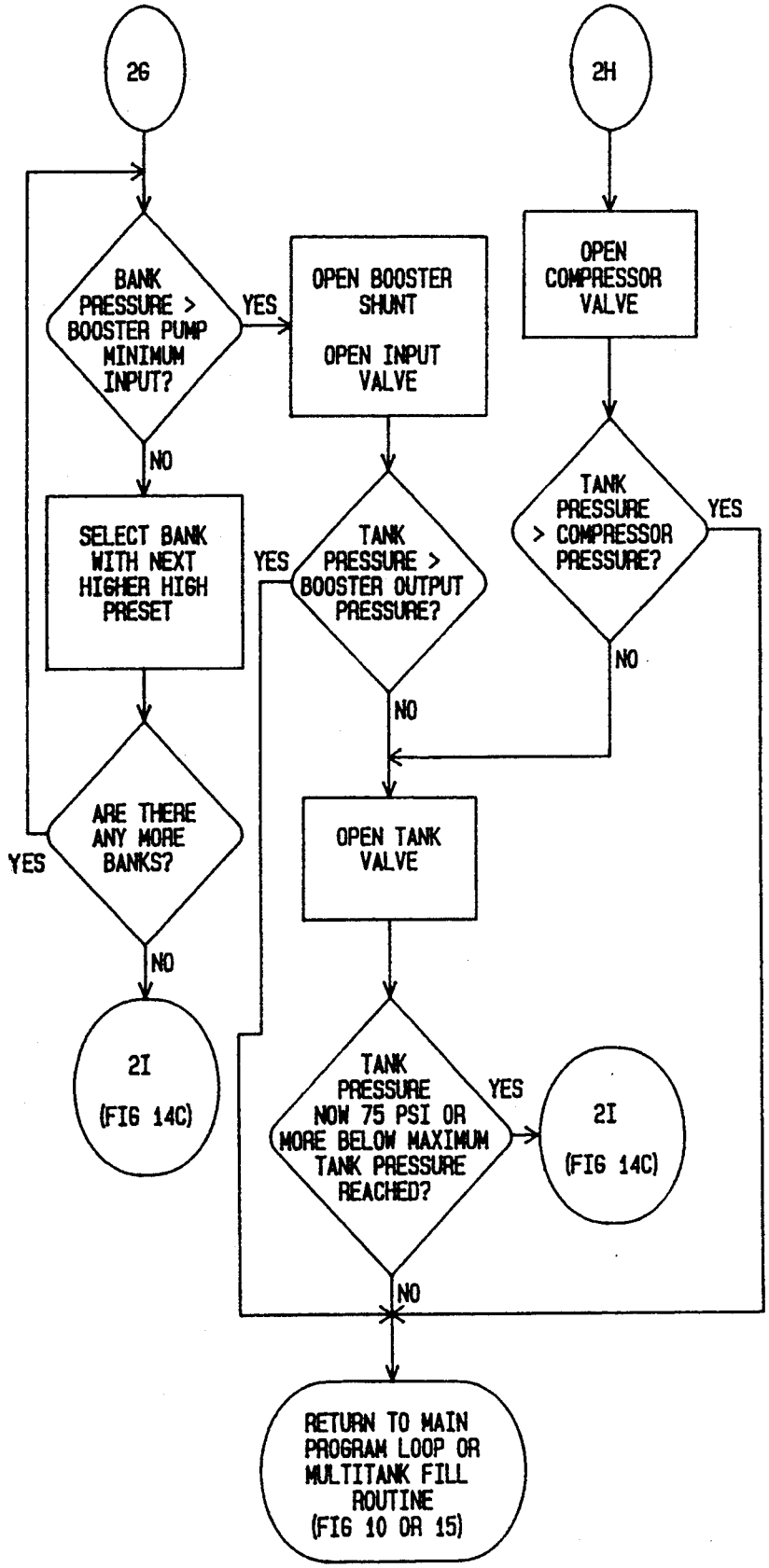

The fill single tank routine or control module is flowcharted in FIGS. 14A, 14B and 14C. This routine determines the appropriate source of compressed air for a tank filling operation (either the compressor, one of the banks, or the booster pump) and determines the filling time appropriate for the tank and the source. Once the actual tank pressure is increased to a point greater than or equal to the tank preset, the tank valve is closed, the tank is removed from the fill queue, and the bank valves, booster shunt valve and input valve are closed.

Figure 26:
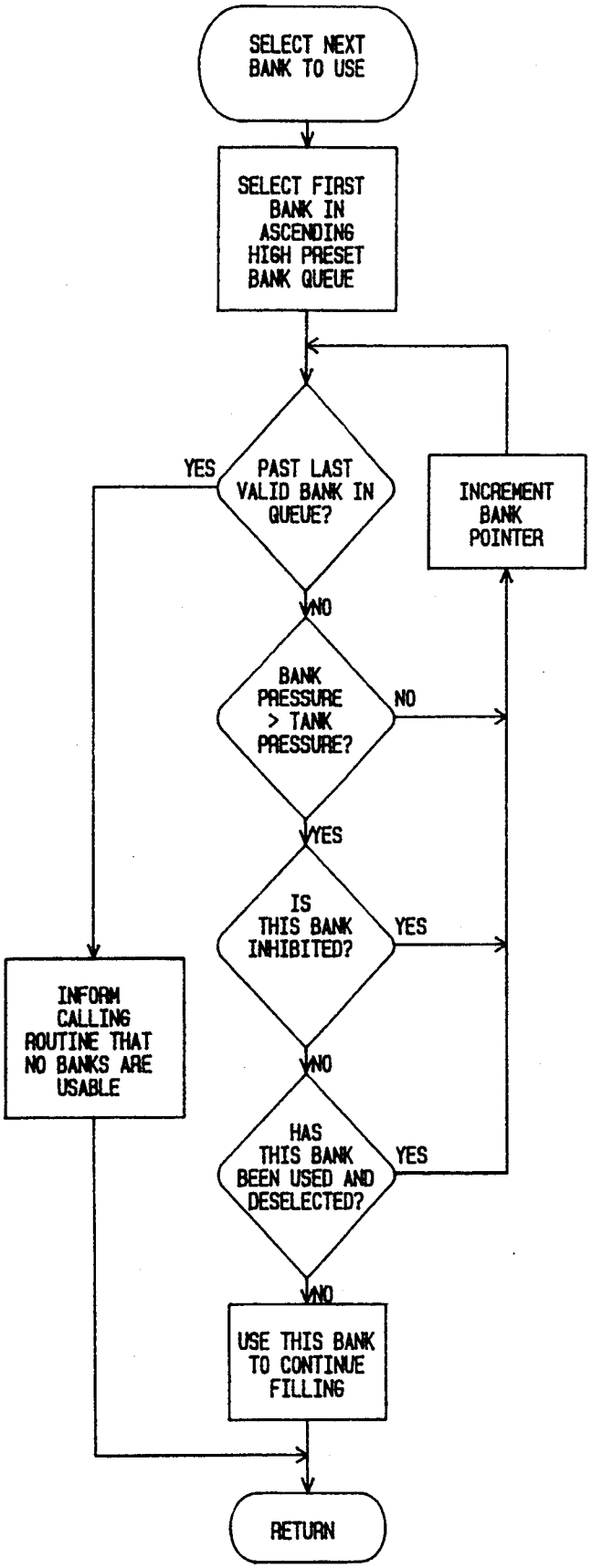

The source of compressed air is chosen using the control module at the lower portion of FIG. 14A and FIG. 14B. The select bank routine of FIG. 26 is called to find the bank having the lowest bank pressure which is greater than the tank pressure and has not been inhibited. It is this bank that is used to continue the filling operation. Once a bank has been selected, the bank valve is opened, the tank valve is opened, and filling commences. If one bank is exhausted, the next bank in the series is selected until all banks have been used. If none of the banks has sufficient pressure to complete a filling operation, the use of the booster pump is evaluated in FIG. 14B and control branches to node 4H (FIG. 14C).

Assuming a booster pump is included in the assembly and the booster pump is not inhibited, the routine selects the bank with the lowest high preset that is greater than the booster pump minimum pressure input. Then the booster shunt valve and the booster input valve are opened. This causes compressed air to flow from the selected bank to the booster pump, which supplies increased pressure compressed air. When the booster output pressure is greater than the tank pressure, the tank valve is opened. In this way, the control module of FIGS. 14B and 14C automatically utilizes the booster pump when necessary to complete a filling operation, when the compressed air stored in the bank or banks is inadequate for the purpose.

The fill single tank routine of FIGS. 14A, 14B and 14C includes another important safety precaution. At several points in the routine, the tank pressure is checked to determine whether or not it has fallen 75 psi or more below the maximum pressure reached in the current filling cycle. If so, this is taken as an indication of a fault, the filling operation is aborted, the tank valve is closed, and the tank is removed from the fill queue. During a normal filling operation it is anticipated that the tank pressure should increase monotonically. Any substantial drop in pressure in the fill conduit during the filling operation is unintended, and the routine detects this condition and prevents it from continuing for any substantial time.

The routine of FIGS. 14A, 14B and 14C provides an effective estimate of the fill time required to fill a tank, in order to increase operating efficiency. A fill valve on a compressed air tank typically includes a small orifice. For this reason, when there is a high rate of air flow through the fill conduit 22, the pressure upstream of the tank valve is substantially higher than the pressure in the tank itself, and the output of the pressure sensor 26 on the fill conduit 22 therefore does not provide an indication of the pressure within the tank. To overcome this problem, the system 10 measures the output of the pressure transducer on the fill conduit only after the valve on the fill conduit has been closed for a sufficient time to allow the pressure in the tank to equilibrate with pressure in the fill conduit.

The routine of FIGS. 14A, 14B and 14C measures the rate of fill of the tank, and then uses this measurement as an aid in calculating a minimum fill time based in part on the size of the tank, and in part on the pressure increase needed before the tank reaches the predetermined set point.

In order to determine the tank size, the pressure in the fill conduit 22 is measured at the start of the fill operation before the valve 24 in the fill conduit 22 is opened, and then the valve 24 is opened for one second. Then the valve in the fill conduit is closed and the tank is allowed to equilibrate with the fill conduit. In the next pass through the routine of FIG. 25, the tank is classified as either a large tank or a small tank, based upon the differential pressure before and after the one second fill. If bank pressure is greater than 3,000 psi and the change in tank pressure is greater than 500 psi, the tank is classified as a small tank. Similarly, if the bank pressure is less than 3,000 psi and the change in tank pressure after the one second fill is greater than 250 psi, the tank is classified as a small tank. Otherwise, the tank is classified as a large tank.

Figure 25:
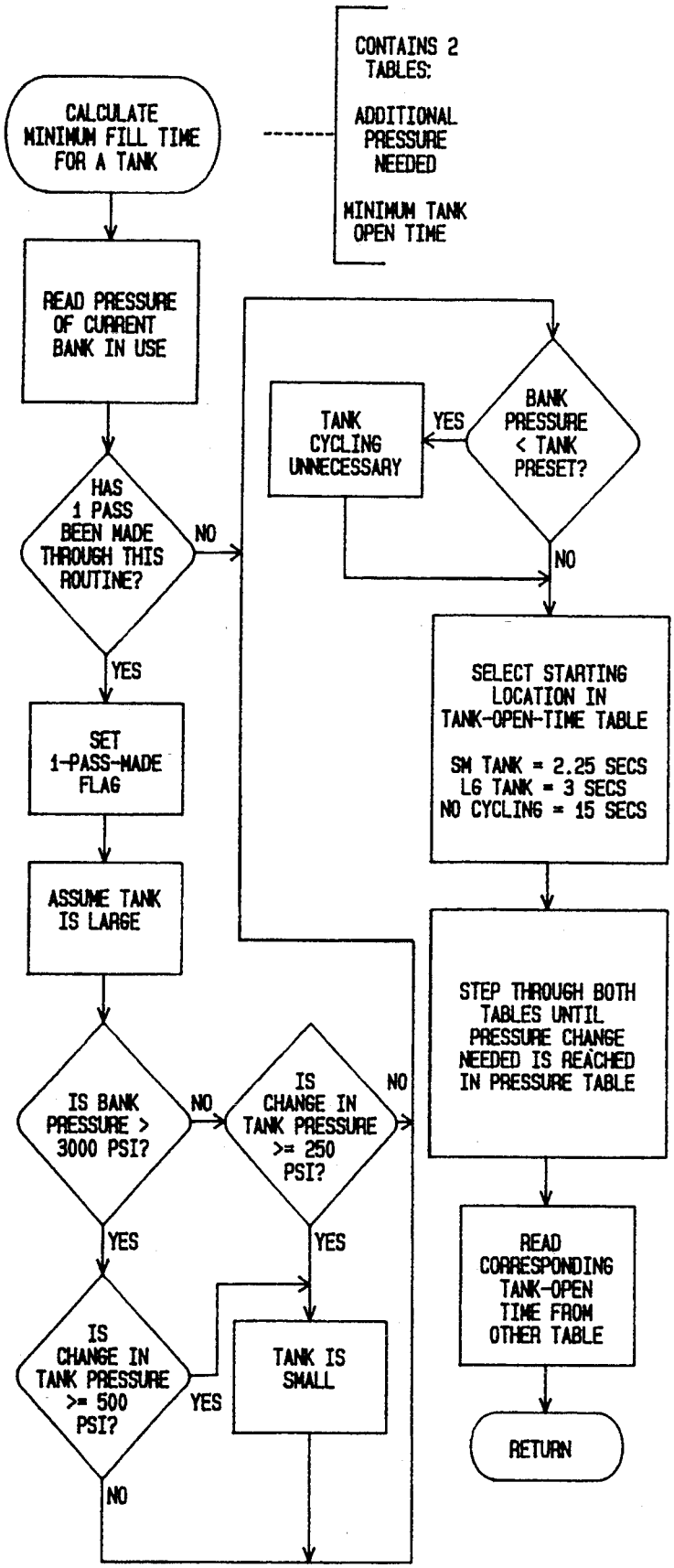

The routine of FIG. 25 then checks to determine whether the bank pressure is less than the tank preset. If so, the minimum fill time is set equal to 15 seconds, a large number which is appropriate because it is not possible for the bank to overfill the tank. Assuming the bank pressure is greater than or equal to the tank preset, the routine of FIG. 25 then uses two tables to select a minimum fill time. The first table is an additional pressure needed table which includes 12 entries as shown in attached Table 1. The second table is a minimum fill time table as shown in attached Table 2.

TABLE 1

Additional Pressure Needed Table

| Entry No. | Entry | Equivalent Pressure Differential Between Tank Preset and Measured Tank Pressure (PSI) |
|---|---|---|
| 1 | 15 | 375 |
| 2 | 30 | 750 |
| 3 | 45 | 1125 |
| 4 | 60 | 1500 |
| 5 | 75 | 1875 |
| 6 | 90 | 2250 |
| 7 | 105 | 2625 |
| 8 | 120 | 3000 |
| 9 | 135 | 3375 |
| 10 | 150 | 3750 |
| 11 | 165 | 4125 |
| 12 | 180 | 4500 |

TABLE 2

Minimum Fill Time Table

| Entry No. | Entry | Equivalent Time (seconds) |
|---|---|---|
| 1 | 1125 | 2.25 |
| 2 | 1500 | 3.00 |
| 3 | 2250 | 4.50 |
| 4 | 3000 | 6.00 |
| 5 | 3750 | 7.50 |
| 6 | 4500 | 9.00 |
| 7 | 5250 | 10.5 |
| 8 | 6000 | 12.0 |
| 9 | 6750 | 13.5 |
| 10 | 7500 | 15.0 |
| 11 | 8250 | 16.5 |
| 12 | 9000 | 18.0 |
| 13 | 9750 | 19.5 |
| 14 | 10500 | 21.0 |
| 15 | 11250 | 22.5 |
| 16 | 12000 | 24.0 |
| 17 | 12750 | 25.5 |
| 18 | 13500 | 27.0 |
| 19 | 14250 | 28.5 |
| 20 | 15000 | 30.0 |
| 21 | 15750 | 31.5 |

The routine of FIG. 25 selects a starting position for the minimum fill time table which is equal to 2.25 seconds for a small tank or 3.00 seconds for a large tank. The routine then increments both the minimum fill time table, using the starting point indicated above, and the additional pressure needed table, starting with the first entry, until the additional pressure needed table entry is greater than or equal to the difference between the current pressure and the set point tank pressure. The corresponding value from the minimum fill time table is then returned by the routine of FIG. 25 as the new calculated minimum fill time.

Note that the new calculated minimum fill time is a function both of the rate of fill of the tank (whether a tank is a small tank or a large tank in the above example) and the difference between the present pressure and the set point tank pressure. This number represents an estimate of the time the tank valve 24 should be opened before it is next closed to allow a subsequent measure of the pressure in the fill conduit 22. Once the tank valve 24 has been opened, it is left open until this minimum fill time has expired, as shown in FIG. 14B following node 4D.

Once this occurs the tank valve is closed and a 3.5 second timer is cycled to allow pressure in the tank and the fill conduit 22 to equilibrate. Then the pressure as measured by the sensor 26 on the fill conduit 22 is read. In the event actual tank pressure is greater than or equal to the tank preset value, the tank valve is closed, the tank is removed from the queue, and control is returned to the main loop or to the multi tank fill routine. In the event the actual tank pressure is still less than the set point tank pressure, a new minimum fill time is calculated and the process described above is repeated. This process continues until the tank is filled to a pressure greater than or equal to the preset value.

Figure 15:
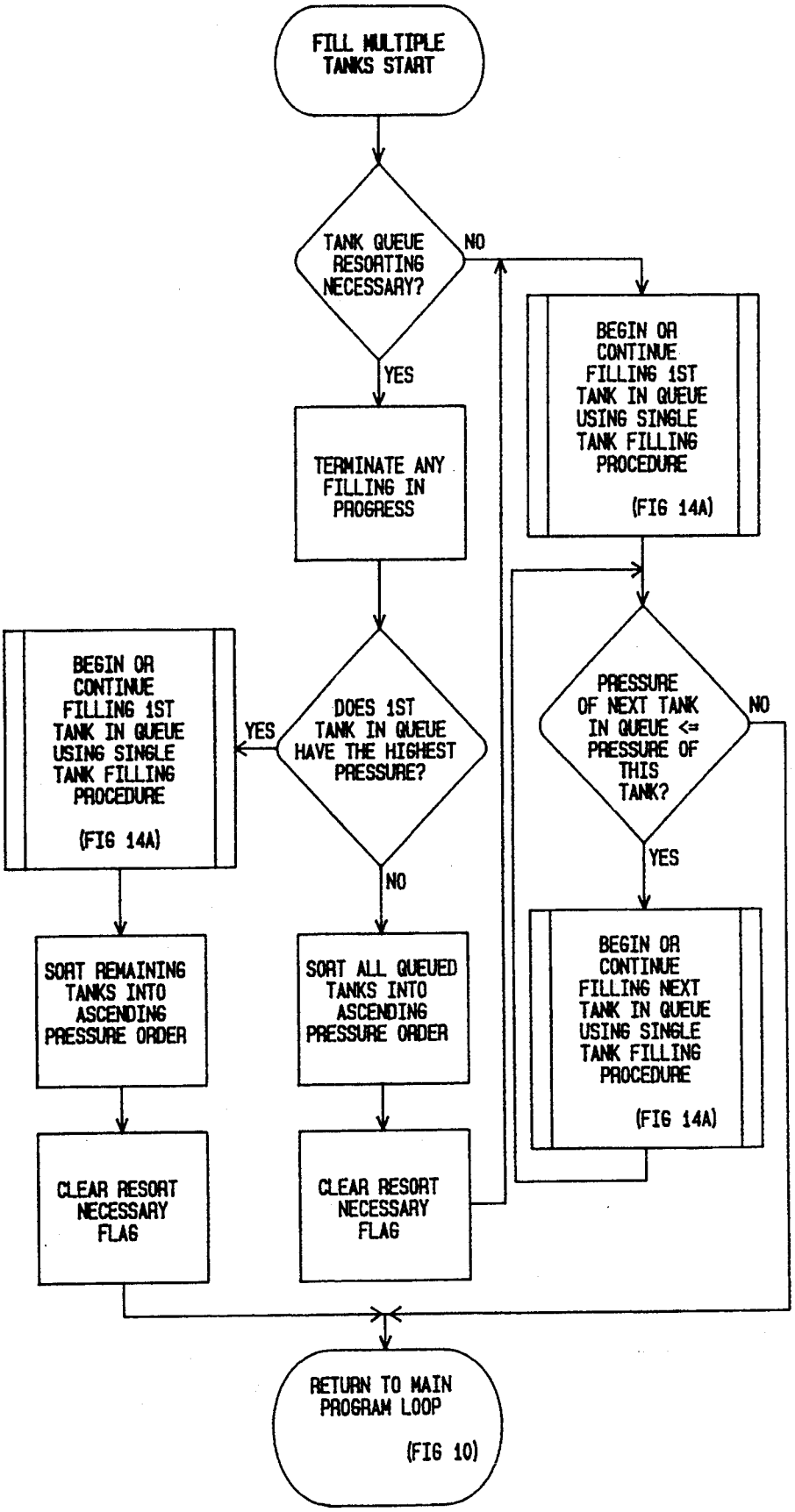

The fill multiple tanks routine of FIG. 15 calls the routine of FIGS. 14A, 14B and 14C and fills all of the tanks in the queue, starting with the tank having the lowest pressure preset, and continuing in a similar manner.

Figure 16A:
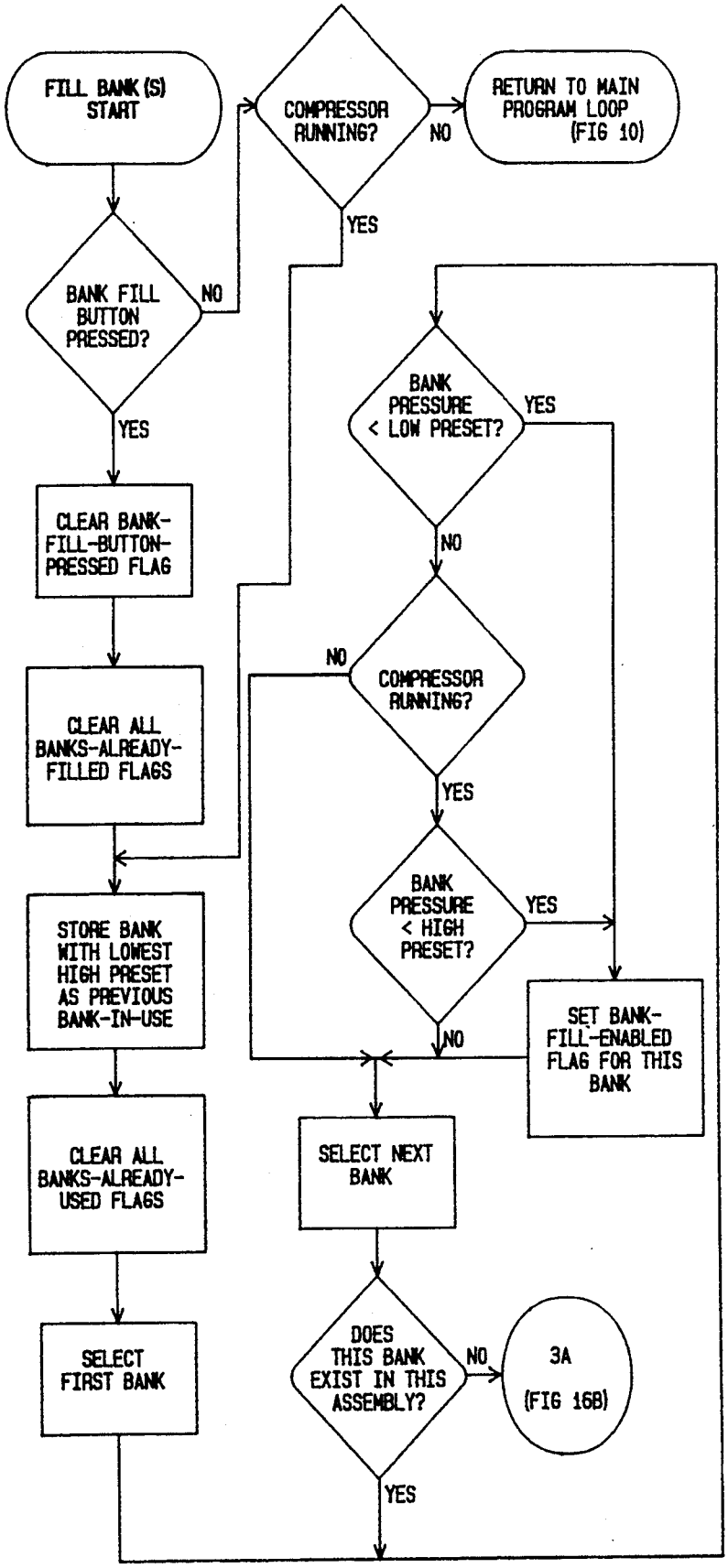
Figure 16B:
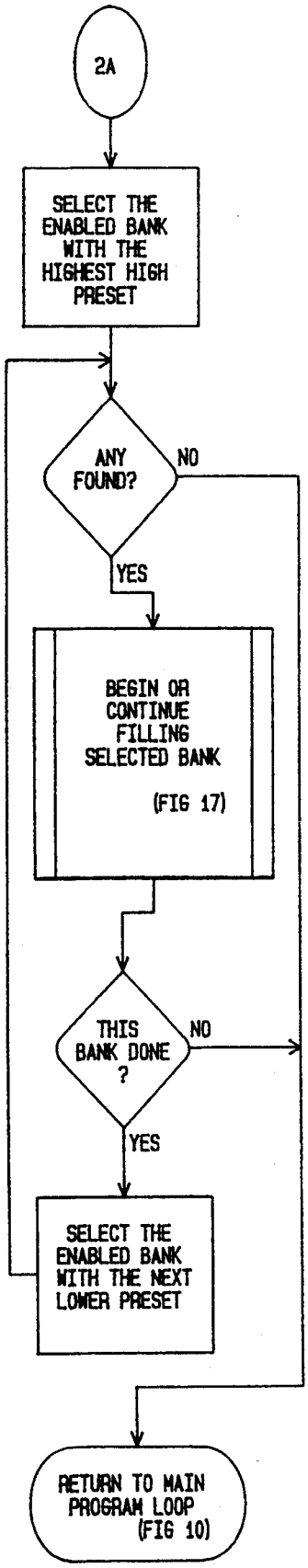
Figure 17A:
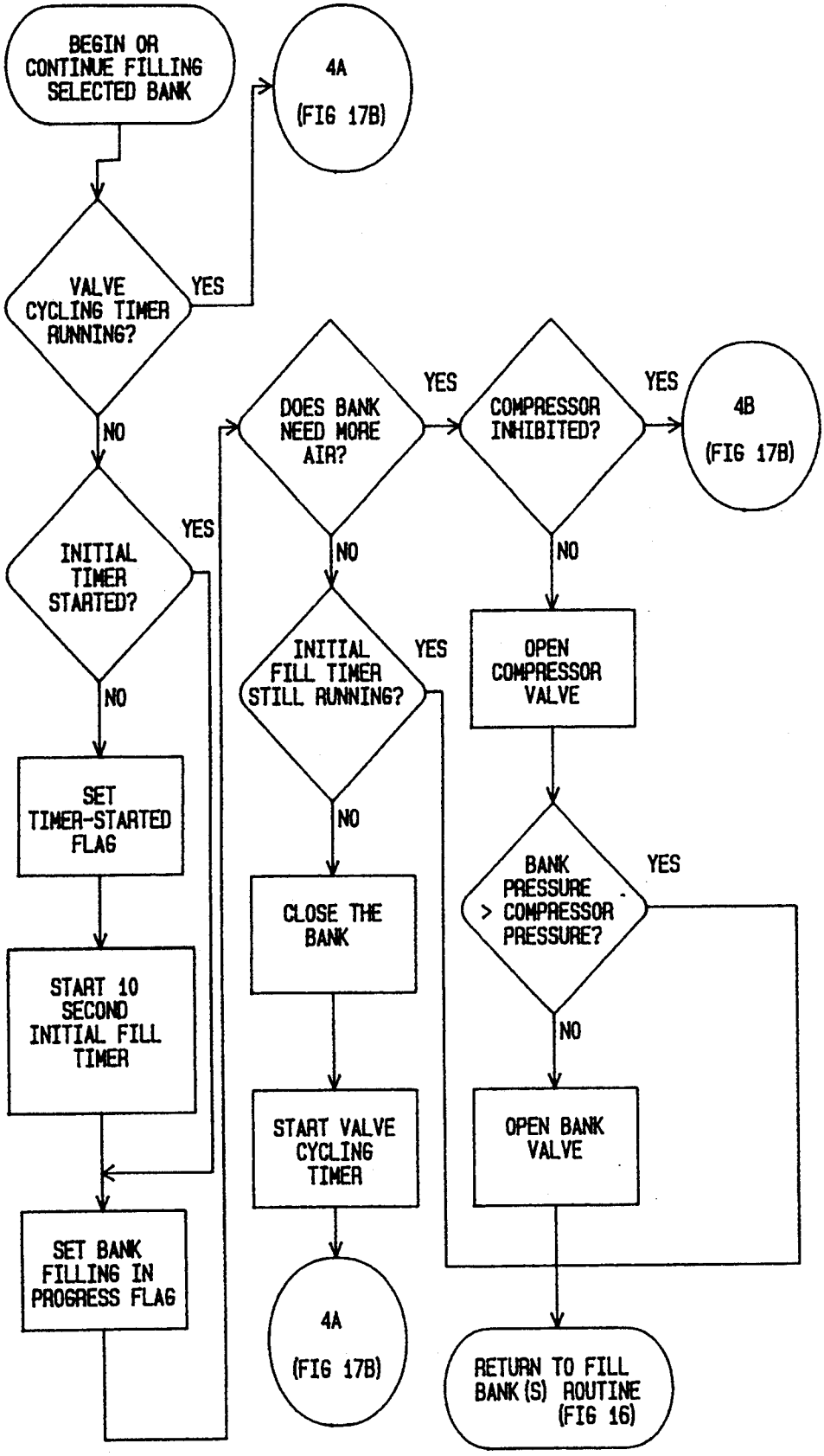
Figure 17B:
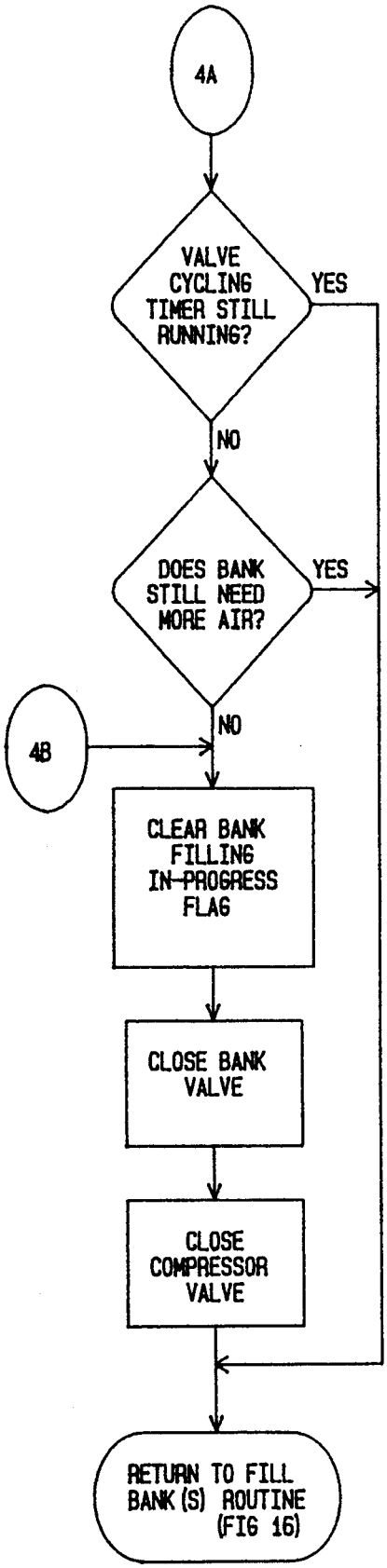

The fill banks routine of FIG. 16 fills banks with compressed air from the compressor. This routine is entered whenever one of the banks falls below one the minimum preset value, and whenever the fill bank button is pressed. If any of the banks has a pressure below its low preset, the bank fill enabled flag is set for this bank. Additionally, if the compressor is running, the bank fill enabled flag for a bank is set when that bank has a pressure less than its high preset value. The fill banks routine of FIG. 16 minimizes compressor cycling, while maintaining an adequate pressure in the banks. The compressor is started if necessary to fill a bank when it is below its low pressure preset value. This bank is filled until it reaches its high pressure preset value. However, once the compressor is running, all of the banks will be filled to their high preset values, even if they have not fallen below their low preset values. Because the routine of FIG. 16 does not wait for each bank to reach its low preset value before filling that bank, a reduced number of compressor cycles is required to maintain the banks properly filled.

The routines of FIGS. 22, 23, 27 and 28 through 30 relate to miscellaneous functions performed by the program for the microprocessor 30, and these routines do not require discussion here.

The following information is provided to define the presently preferred embodiment, and is not intended to limit the scope of the following claims in any way. By way of example, the components of Table 3 have been found to be suitable.

TABLE 3

Presently Preferred Components

| Ref. No. | Description | Manufacturer | Part No. |
|---|---|---|---|
| 26 | Pressure Transducer | Ashcroft | ASH-K8-S-100-7-MO1-MV-F1 |
| 30 | Microprocessor | Motorola | 68HC11 |
| 32 | EPROM | Advanced Micro Devices | 27C256 |
| 134,136 | Motor and Gearbox | P&P | GM-2006 |
| 142 | Clutch | Helander | M50S-5-CW-24 |
| 148 | Ball Valve | Whitey | SS-33-VS4 |

A listing of the preferred form of the program for the microprocessor 30 and the preferred circuitry for this embodiment can be found in the appendices to a related U.S. patent application 08/106,394 filed on the same date as the present specification, entitled "Filling System for Compressed Gas Tanks" which appendices are hereby incorporated by reference.

The system 10 is modular, to allow control panels to be assembled as needed for the particular application. Solid state pressure transducers are used to ensure the greatest possible accuracy. Stainless steel is used wherever possible to minimize corrosion, and in particular for substantially all of the components of the air path, and pneumatic components are rated to 6000 psi. All switches are sealed (with rubber sealing boots for smaller switches and O-ring seals for larger switches), and the enclosure seams are caulked with silicone rubber to make the system weather and water resistant. Displays are large and bright so they are visible from a distance. An audible tone sounds when a fill operation is complete.

From the foregoing it should be apparent that an improved tank filling system has been described. The system 10 fills the tank quickly and efficiently, using the techniques described above to reduce the filling time, while avoiding the need for a pressure sensor within the tank itself, pressure regulators, or flow modulators. The system 10 fills the banks automatically and reliably, while minimizing compressor cycling. The system 10 utilizes a booster pump to complete tank filling operations when bank pressure is inadequate, allowing tank filling operations to continue when a compressor is unavailable, or alternately reducing undesired compressor cycling when a compressor is available. The system 10 utilizes valves which automatically close when power is lost, and which cycle in a manner chosen to reduce physical and thermal shocks to the system. A number of safety features are included which guard against common operator errors.

Of course, it should be understood that a wide range of changes and modifications can be made to the preferred embodiment described above. As pointed out previously, the tank filling system of this invention can be adapted for use with other gases, and other types of tanks. The system may be implemented with other types of controllers, which may be programmed in other languages. The basic functions described above can be implemented with a wide range of software algorithms and hardware controllers. Various ones of the features described above can be used separately, or they can be combined as described above in connection with the system 10.

It is therefore intended that the foregoing detailed description be regarded as illustrative rather than limiting, and that it be understood that it is the following claims, including all equivalents, which are intended to define the scope of this invention.

We claim:

1. In a compressed gas tank filling system of the type comprising a source conduit configured for connection to a source of compressed gas, a fill conduit configured for connection to a tank to be filled, a flow control conduit interconnecting the source conduit and the fill conduit; a flow control valve coupled to the flow control conduit to control the flow of compressed gas therethrough; a pressure transducer in one of the conduits, downstream of the flow control valve, and a controller coupled to the flow control valve and responsive to the pressure transducer; the improvement wherein said control valve comprises:

an on/off valve;

a motor coupled to the on/off valve to drive the on/off valve to an open position;

a clutch interposed between the motor and the on/off valve, said clutch interconnecting the motor and the on/off valve when an operating voltage is supplied, said clutch disconnecting the motor and the on/off valve when the operating voltage is absent; and a spring biasing the on/off valve to a closed position with sufficient force to close the on/off valve when the clutch disconnects the motor and the on/off valve;

wherein the motor exerts a drag on the on/off valve when the motor is de-energized and the operating voltage is supplied to the clutch, said drag being sufficient to prevent the spring from closing the on/off valve.

2. The invention of claim 1 wherein the clutch is coupled to the on/off valve by a shaft, and wherein the spring comprises a coil mounted around the shaft.

3. The invention of claim 1 further comprising:

a two-state switch coupled to the valve such that the switch is in a first state when the valve is open and in a second state in all other positions of the valve.

4. The invention of claim 1 wherein the spring continuously biases the valve to the closed position.

5. The invention of claim 1 wherein the motor gradually opens the valve to reduce thermal and physical shock associated with valve opening.

6. The invention of claim 5 wherein the motor moves the valve from a fully closed position to a fully open position in about 2.5 seconds.

* * * * *